US006135671A

United States Patent [19]

Yasu et al.

[11] Patent Number: 6,135,671

[45] Date of Patent: Oct. 24, 2000

[54] PAVING MATERIALS LOADING APPARATUS AND PAVING MACHINE

[75] Inventors: Hidenori Yasu; Tatsuoki Inagaki; Hajime Sugata; Chiaki Matsuura; Katsuro Hasebe; Ryuzi Izawa; Akio Mori; Nobuyuki Watanabe, all of Tokyo; Fumio Goto; Shinichiro Uchiyama, both of Gumma-gun, all of Japan

[73] Assignee: Niigata Engineering Co., Ltd., Tokyo, Japan

[21] Appl. No.: 09/258,753

[22] Filed: Feb. 26, 1999

[30] Foreign Application Priority Data

| | | | |
|---|---|---|---|
| Feb. 27, 1998 | [JP] | Japan | 10-048208 |
| Feb. 27, 1998 | [JP] | Japan | 10-048209 |
| Feb. 27, 1998 | [JP] | Japan | 10-048211 |
| Feb. 27, 1998 | [JP] | Japan | 10-048212 |
| Mar. 3, 1998 | [JP] | Japan | 10-051128 |
| Mar. 10, 1998 | [JP] | Japan | 10-058684 |
| Jul. 29, 1998 | [JP] | Japan | 10-214610 |
| Dec. 28, 1998 | [JP] | Japan | 10-372183 |

[51] Int. Cl.[7] ..... B65G 67/08; E01C 19/00

[52] U.S. Cl. ..... 404/108; 414/339; 414/343; 414/398; 414/519; 414/520

[58] Field of Search ..... 404/82, 108, 110, 404/118, 104, 80, 81; 414/339, 343, 398, 502, 528, 519, 520

[56] References Cited

U.S. PATENT DOCUMENTS

| | | | |
|---|---|---|---|
| 3,054,334 | 9/1962 | Barber . | |
| 4,379,653 | 4/1983 | Brown | 404/118 |
| 4,818,139 | 4/1989 | Brock et al. | 404/81 |
| 5,015,120 | 5/1991 | Brock et al. | 404/108 |
| 5,035,534 | 7/1991 | Brock et al. | 404/81 |
| 5,073,063 | 12/1991 | Brown | 404/101 |
| 5,100,277 | 3/1992 | Musil . | |
| 5,114,267 | 5/1992 | Smith et al. . | |
| 5,529,434 | 6/1996 | Swisher, Jr. | 404/108 |
| 5,553,968 | 9/1996 | Campbell | 404/108 |
| 5,735,634 | 4/1998 | Ulrich et al. | 404/102 |
| 5,846,022 | 12/1998 | Grundl | 404/101 |

FOREIGN PATENT DOCUMENTS

| | | |
|---|---|---|
| 59-107613 | 7/1984 | Japan . |
| 2-221502 | 9/1990 | Japan . |
| 9-505370 | 5/1997 | Japan . |
| 95/14820 | 6/1995 | WIPO . |

*Primary Examiner*—James A. Lisehora
*Attorney, Agent, or Firm*—Fish & Richardson, P.C.

[57] ABSTRACT

The invention relates to a paving materials loading apparatus. In particular, a paving materials loading feeder 16 is so disposed that a lower end 19*a* of a loading frame 19 thereof is connected to a receiving hopper 17, a discharge port 19*c*, 19*d* is formed in a middle part of the loading frame 19 between the lower end 19*a* and a discharge end 19*b*, and a lid 35 is provided on the discharge port 19*c*, 19*d* so as to be openable and closable. The loading feeder 16 may also be raised and lowered. The invention also relates to a paving machine provided with a front hopper 2 and a rear hopper 3, on a self-propelled vehicle 1. In particular, the paving materials loading apparatus of the above construction is mounted on the self-propelled vehicle 1 so that the discharge port 19*c*, 19*d* of the loading feeder 16 is located above the front hopper 2 and the discharge end 19*b* of the loading feeder 16 is located above the rear hopper 3.

43 Claims, 33 Drawing Sheets

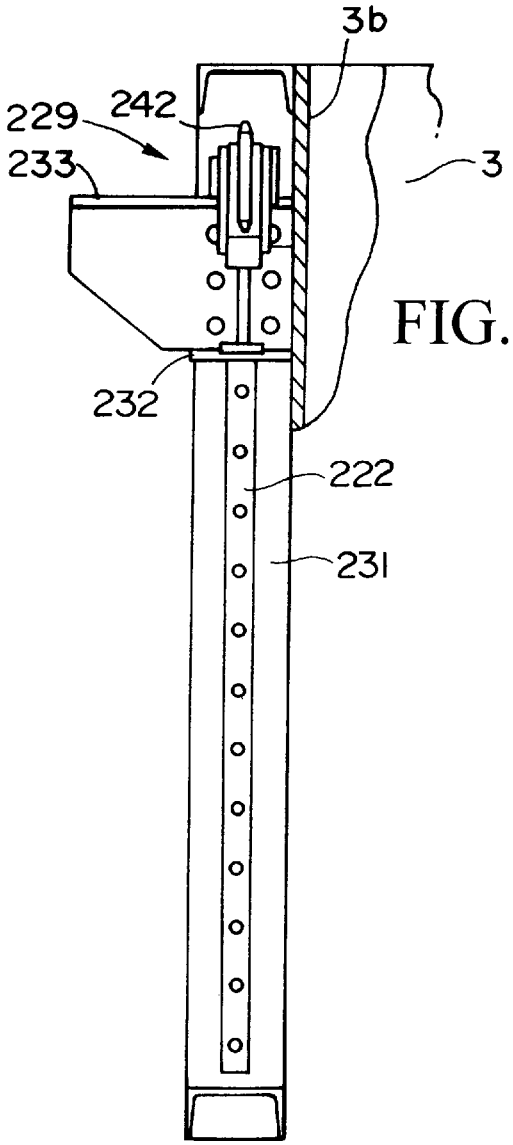
FIG.17
FIG.18
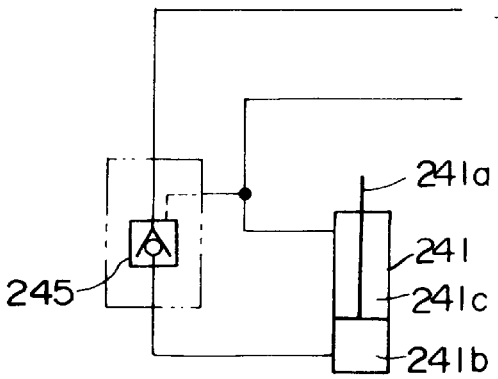

PAVING MATERIALS LOADING APPARATUS AND PAVING MACHINE

BACKGROUND OF THE INVENTION

1. Field of the Invention

The present invention relates to a paving materials loading apparatus for loading paving materials such as asphalt mixture or the like into a hopper, and to a paving machine such as an asphalt finisher or the like, mounting the screed.

This application is based on patent application No. Hei 10-48208, Hei 10-48209, Hei 10-48211, Hei 10-48212, Hei 10-51128, Hei 10-58684, Hei 10-214610, and Hei 10-372183 filed in Japan, the content of which is incorporated herein by reference.

2. Description of the Related Art

A paving machine as shown in FIG. 38 has been proposed (Published Japanese Translation No. Hei 9-505370 of PCT International Application). This paving machine comprises, mounted on a self-propelled vehicle 81, a front hopper 82, a rear hopper 83, a front spreading screw 85 for spreading paving materials Ha such as asphalt mixture or the like fed from the front hopper 82 via a feeder (not shown), a rear spreading screw 87 for spreading sideways paving materials Hb fed from the rear hopper 83 via a feeder 86, a front screed 88 for laying and paving the paving materials Ha spread by the front spreading screw 85, and a rear screed 89 for laying and paving the paving materials Hb spread by the rear spreading screw 87 onto the road surface. The front screed 88 is supported by an arm 90 extending rearward under the feeder 86, and the rear screed 89 is suspended by a pair of left and right leveling arms 92 which are supported by a pivot shaft 91 on the self-propelled vehicle 81 so as to be pivotal up and down.

The feeder 86 is provided with a conveyor which is formed by an endless belt passing around two rotation shafts, and a screw connected to the rotation shafts on the input side of the conveyor, which feeds the paving materials in the hopper to the conveyor side.

With this paving machine, two kinds of paving materials Ha and Hb can be laid and paved one on top of the other on the road surface at the same time with one paving operation.

However in the case of this paving machine, in order to supply the paving materials Hb to the rear hopper 83 this must be loaded into the rear hopper 83 over the front hopper 82. Accordingly, there is the problem that a dump truck or the like with a dedicated loading apparatus must be used.

Furthermore, since the paving machine is provided with hoppers 82, 83 and the screeds 88, 89 respectively positioned in pairs at the front and rear, the machine itself becomes large, interrupting the front view of an operator who sits on a driving seat at the rear of the vehicle. Therefore, the driving seat is provided at a high position to widen the front view of the operator. A high driving seat however causes problems such as when the paving machine is loaded on a trailer and deadheaded, the trailer cannot pass through a tunnel having a low ceiling, or that it is not convenient for the operator to get on and off.

Moreover, since the front screed 88 is independently supported by the arm 90 of the rear screed 89 which is suspended from the leveling arms 92, then when the paving materials Hb are laid and paved by the rear screed 89 on top of the paving materials Ha paved by the front screed 88, there is the problem that the paving thickness of the upper paving materials Hb cannot be accurately controlled.

Furthermore, since two hoppers, namely the front hopper 82 and the rear hopper 83, are mounted, then as a result of holding a space to arrange both the hoppers 82 and 83 there is the problem that the whole paving machine becomes large. To reduce the size of the paving machine it has been considered to narrow the space for locating the hoppers. In this case however, the volume of the hoppers 82, 83 is reduced and hence the operation of loading the paving materials into the hoppers 82, 83 must be performed frequently. Therefore, there is the problem for dropping the operating efficiency.

SUMMARY OF THE INVENTION

The present invention relates to paving materials loading apparatus and is characterized in that; paving material loading feeder is so disposed that a lower end of a loading frame thereof is connected to a receiving hopper, a discharge port is formed in a middle part of said loading frame between the lower end and a discharge end, and a lid is provided on the discharge port so as to be openable and closable.

Preferably, the loading feeder can be raised and lowered. The receiving hopper may be provided with wheels for supporting the load of the receiving hopper, and the receiving hopper may be connected to the loading feeder so as to be pivotal up and down.

Moreover, the present invention, with paving material loading apparatus in which the loading feeder can be raised and lowered, and the receiving hopper is provided with wheels for supporting the load of the receiving hopper, is characterized in that the loading feeder can be freely moved fore and aft and can be freely tilted from side to side, the loading feeder is provided with a stop member for stopping rearward movement of the loading feeder, and the receiving hopper is provided with a pushing member for pushing against a dump truck or the like which replenishes the paving materials into the receiving hopper.

With the loading apparatus, it is possible to provide supplementary hoppers on the left and right sides of the receiving hopper so as to be foldable over the receiving hopper. The loading feeder may be formed, for example, by tensioning an endless chain with flights attached thereto, between rotation shafts rotatably disposed respectively at the lower end and the discharge end of the loading frame. It is also possible to provide at least two discharge ports in the loading feeder at positions spaced apart to the paving materials transfer direction.

Moreover, the present invention, with a paving machine provided with a front hopper and a rear hopper, on a self-propelled vehicle, is characterized in that the loading apparatus is mounted on the self-propelled vehicle so that the discharge port of the loading feeder is located above the front hopper and the discharge end of the loading feeder is located above the rear hopper.

Furthermore, the present invention, with a paving machine in which a conveyor apparatus comprising a loading feeder which is formed by an endless belt passing around two rotation shafts disposed in parallel with each other with a predetermined spacing, and a screw mounted on the input side of the loading feeder, which feeds materials to the loading feeder side is fitted in a receiving hopper disposed in a front part of the self-propelled vehicle, is characterized in that a rotation shaft for supporting the screw, and a rotation shaft on the input side of the loading feeder are disposed independent of each other, and a driving source for the screw and a driving source for the loading feeder are independently provided.

In this case, the rotation shaft of the screw and the rotation shaft on the input side of the loading feeder may be connected rotatably relative to each other via a bearing. The screw may be disposed on the left and right sides of the rotation shaft on the input side of the loading feeder and separate drive sources may be provided for the left and right screws.

Moreover, the present invention, with a paving machine provided with a driving apparatus, is characterized in that the driving apparatus has a vertical rail arranged in an upright condition on the self-propelled vehicle, a floor connected to vertical rails so as to be freely movable up and down along the vertical rail, a driving seat and driving equipments disposed on the floor, and an elevating apparatus for moving the floor up and down.

In this case, the elevating apparatus may have for example, an elevating cylinder, a sprocket which is moved up and down by the elevating cylinder, and an elongate member wrapped around the sprocket, with one end thereof fixed to a member on the self-propelled vehicle side and an other end thereof fixed to a member on the floor side.

Moreover, a pair of left and right driving seats may be disposed on the floor so as to be movable from side to side, and a steering wheel for driving equipment may be disposed so as to be movable from side to side.

Furthermore, the present invention is characterized in that; a front hopper and a rear hopper for storing paving materials, a front spreading screw for spreading sideways the paving materials fed from the front hopper, a rear spreading screw for spreading sideways the paving materials fed from the rear hopper, a front screed for laying and paving the paving materials spread by the front spreading screw, and a rear screed for laying and paving the paving materials spread by the rear spreading screw are mounted on the self-propelled vehicle, and the driving apparatus is disposed rearward of the rear hopper.

Preferably, in this case, the vertical rail is attached to a lift frame on a back wall of the rear hopper.

Moreover, the present invention, with a paving machine where a front hopper and a rear hopper for storing paving materials, a front spreading screw for spreading sideways the paving material fed from the front hopper, a rear spreading screw for spreading sideways the paving materials fed from the rear hopper, a front screed for laying and paving the paving materials spread by the front spreading screw, and a rear screed for laying and paving the paving materials spread by the rear spreading screw are mounted on a self-propelled vehicle, is characterized in that the front screed and the rear screed are respectively suspended apart in the fore and aft direction and so as to be movable relatively in the vertical direction, on a pair of left and right leveling arms supported by a pivot shaft on the self-propelled vehicle so at to be pivotal up and down.

Preferably, in this case, at least one of the front screed and the rear screed is extensible and retractable sideways. Moreover, the rear hopper is preferably disposed so that paving materials drop port is located above the rear spreading screw.

Furthermore, the present invention, with a paving machine where a hopper for storing paving materials, a spreading screw for spreading sideways the paving materials fed from the hopper, and a screed for paving the paving materials spread by the spreading screw, are mounted on a self-propelled vehicle, is characterized in that the hopper has a drop port which can be opened and closed by an opening/closing means, and the drop port is located above the spreading screw.

Preferably, in this case, the hopper is provided with a plurality of drop ports respectively provided with the opening/closing means. More preferably, the plurality of drop ports are formed substantially linearly in the widthwise direction of the hopper.

As the opening/closing means, for example, a shutter which is moved by an actuator for opening and closing the drop port, or a rotation roll which is rotated by a motor to let the paving materials fall from the drop port are used. These opening/closing means may be disposed in the same drop port.

Moreover, the present invention, with a paving machine where propulsion crawlers formed by an endless crawler body wrapped around a pair of driving wheels positioned in spaced apart relation in the fore and aft directions are provided on left and right lower portions of the vehicle body, is characterized in that the left and right crawlers are provided separately as front crawlers and rear crawlers.

Preferably, in this case, the front crawlers can be turned in the horizontal direction. More preferably, the front crawlers on the left and right sides are connected by a tie rod and turned through at an angle with specific relation. Similarly, the rear crawlers can be turned in the horizontal direction.

Furthermore, the present invention, with a paving machine where a hopper for storing paving materials, a spreading screw for spreading sideways the paving materials fed from the hopper, and a screed for laying and paving the paving materials spread by the spreading screw are mounted on a self-propelled vehicle, is characterized in that a plurality of hoppers are provided shifted vertically so that at least a part of the hoppers overlap from above view.

Preferably, in this case, of the plurality of hoppers, the structure is such that an upper hopper is provided shifted rearward, and a lower hopper is provided shifted forward, a front part of a bottom face of the upper hopper can be opened and closed, and when the front part is in the open condition, the lower hopper is positioned below the opening. A bottom face of the upper hopper may be able to be pivoted so as to be inclined towards a paving materials discharge port side.

The total loading capacity of the front hopper and the rear hopper can be enlarged at least the loading capacity of the dump truck which feeds the paving materials to the hopper. Furthermore, it is possible to provide engines on the left and right sides of the loading feeder.

BRIEF DESCRIPTION OF THE DRAWINGS

FIG. 17 is a side view of the elevating apparatus in the driving apparatus shown in FIG. 11.

FIG. 18 is a hydraulic circuit diagram of the elevating apparatus in the driving apparatus shown in FIG. 11.

DESCRIPTION OF THE PREFERRED EMBODIMENTS

First Embodiment

Figure 1:
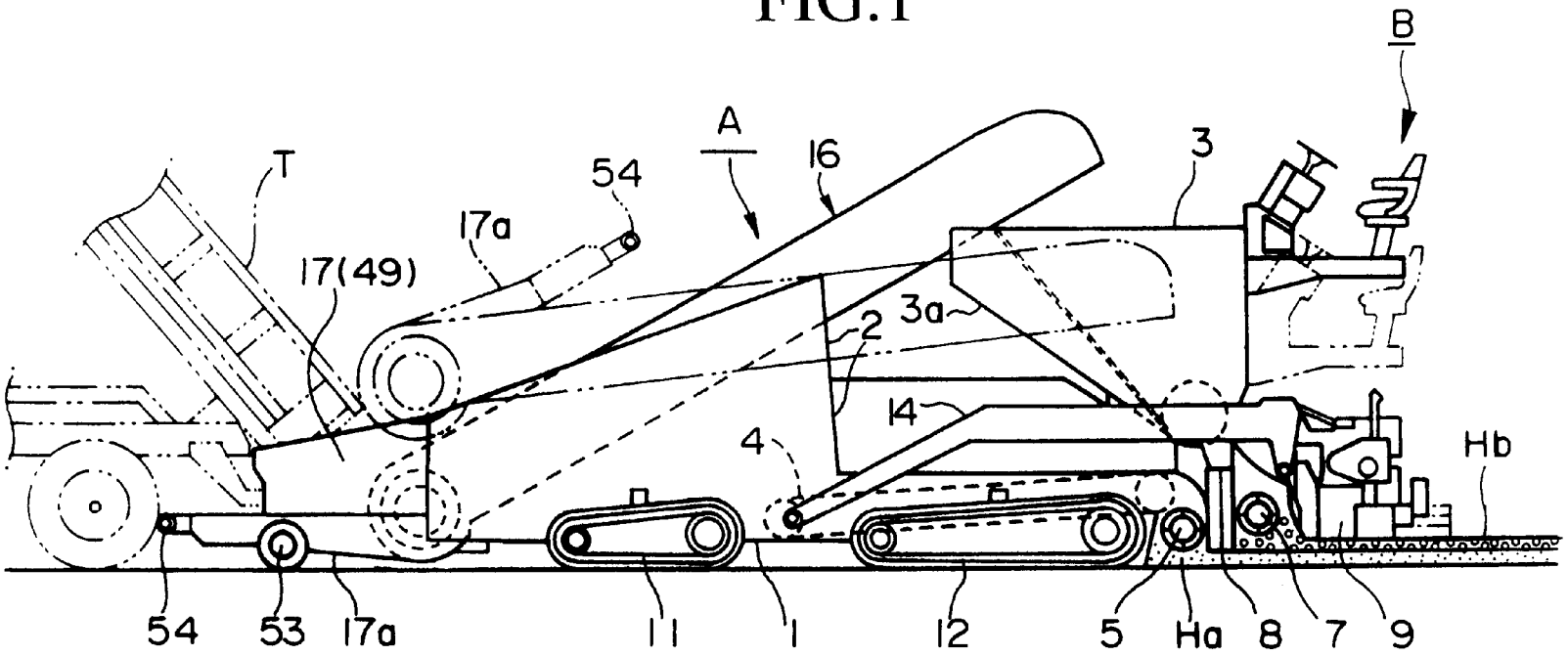
FIG. 1 is a side view of a paving machine showing one embodiment of the present invention.
Figure 2:
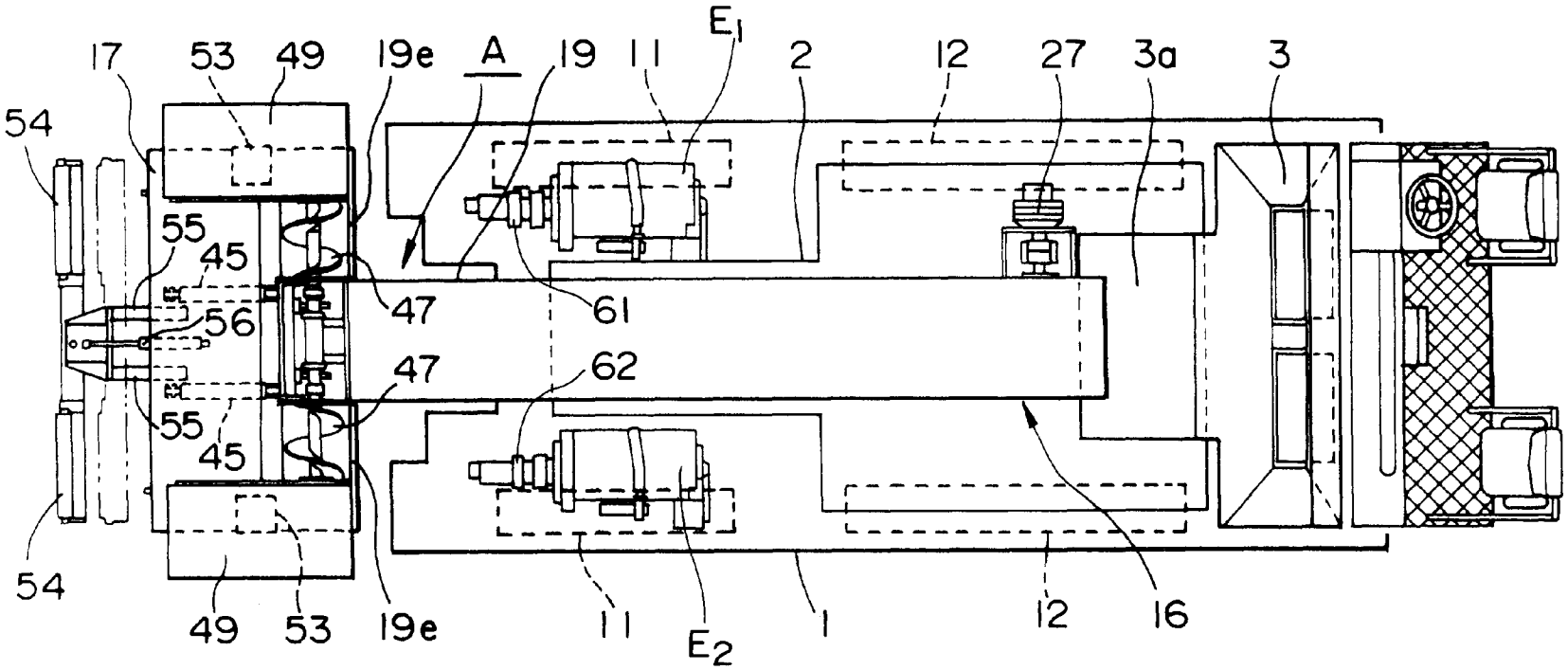
FIG. 2 is a plan view of the paving machine shown in FIG. 1.

An embodiment of the present invention will now be described with reference to FIG. 1 through FIG. 10.

Reference number 1 denotes a self-propelled vehicle. The self-propelled vehicle 1 comprises a front hopper 2, a rear hopper 3, a front spreading screw 5 for spreading sideways paving materials Ha fed from the front hopper by a bar feeder 4, a rear spreading screw 7 for spreading sideways paving materials Hb discharged from the rear hopper 3, a front screed 8 for laying and paving the paving materials Ha spread by the front spreading screw 5, a rear screed 9 for laying and paving the paving materials Hb spread by the rear spreading screw 7, and a loading apparatus A for the paving materials.

The rear screed 9 is suspended from a rear end of a pair of left and right leveling arms 14, and the front screed 8 is suspended by the leveling arms 14 between the spreading screws 5 and 7 so that the position thereof can be vertically adjusted. The self-propelled vehicle 1 has two pairs of left and right crawlers 11 and 12, and is propelled by driving these crawlers.

At the front part of the self-propelled vehicle 1 (on left and right sides of the loading feeder 16 described later) is respectively mounted hydraulic pumps 61 and 62, and engines $E_1$, $E_2$ are respectively connected to the shafts of these hydraulic pumps 61, 62 via couplings. The hydraulic pumps 61, 62 are driving sources for various kinds of equipment such as hydraulic motors which propel the self-propelled vehicle 1 via the crawlers 11 and 12, hydraulic cylinders and the like.

Figure 3:
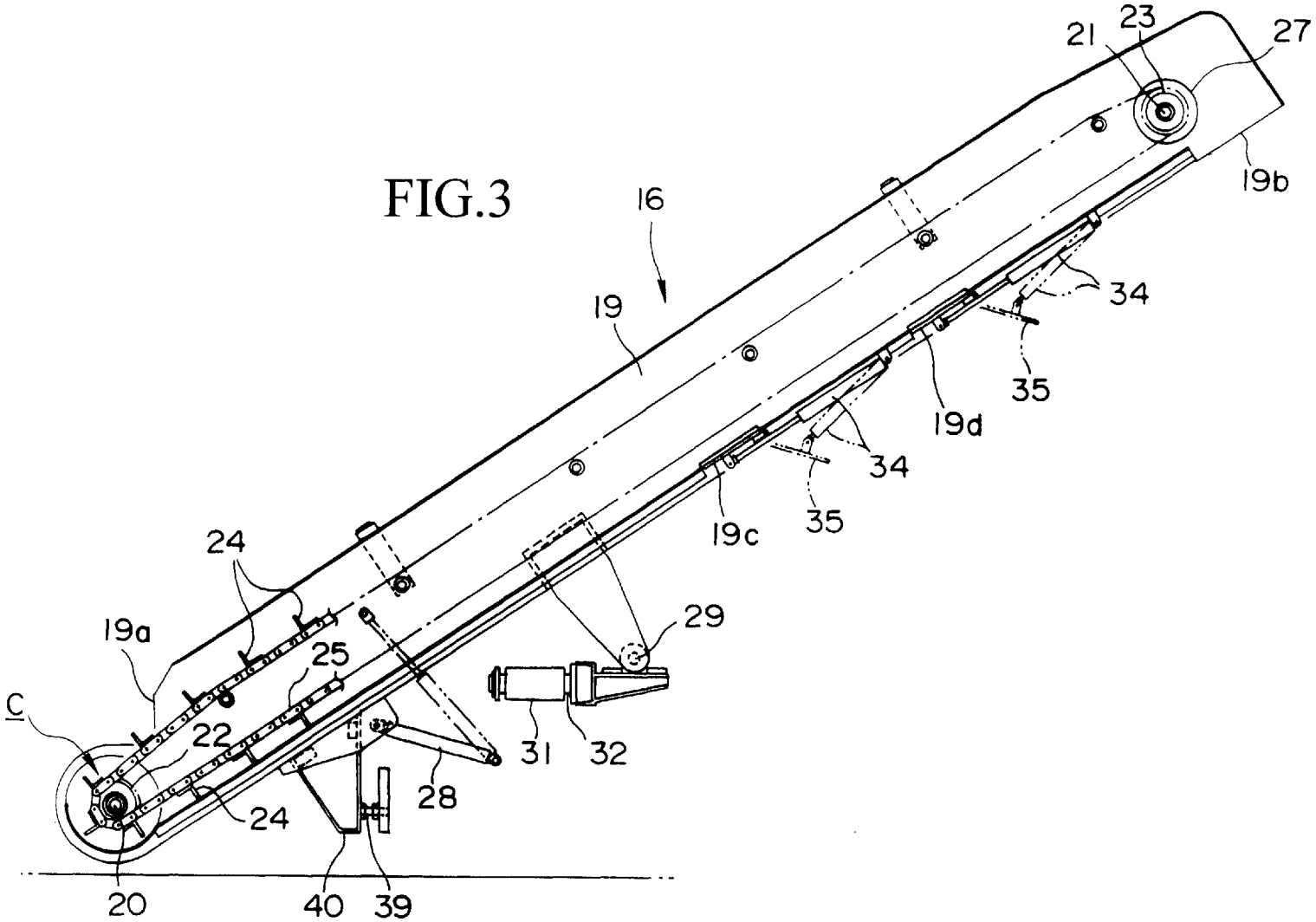
FIG. 3 is a sectional view showing the main parts of a loading feeder in the embodiment of the present invention.
Figure 4:
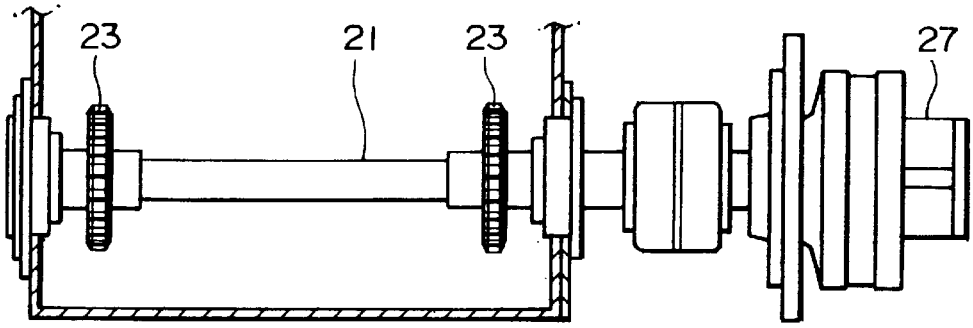
FIG. 4 is a sectional view showing the relationship between a rotation shaft of the loading feeder and a driving motor in the embodiment of the present invention.

The loading apparatus A principally comprises a loading feeder 16 and a receiving hopper 17. The loading feeder 16 as shown in FIG. 3, is formed by tensioning an endless chain 25 having a number of flights 24 with a predetermined spacing, between respective sprockets 22 and 23 of rotation shafts 20 and 21 respectively disposed at one end (lower end) 19*a* and the other end (discharge end) 19*b* of a loading frame 19. The endless chain 25 rotates upon actuation of a motor 27 (see FIG. 4) connected to one end of the rotation shaft 21, and as a result, paving materials Ha or Hb scooped by the flights 24 are transferred from the lower end 19*a* of the loading frame 19 toward the discharge end 19*b* disposed directly above the rear hopper 3.

The loading feeder 16 is supported by a pivot shaft 29, and is pivoted up and down vertically about the pivot shaft 29 by operating a pivoting cylinder 28. The pivot shaft 29 is mounted on a movable shaft 32 which is inserted into a fixed cylinder 31 fixed to the self-propelled vehicle 1, so as to be movable back and forth (from side to side in FIG. 3) Accordingly, the loading feeder 16 can be moved back and forth within a moving range of the movable shaft 32, and can be freely titled from side to side, relative to the self-propelled vehicle 1. At the time of pivoting the loading feeder 16 downward, a front plate 3*a* of the rear hopper 3 (see FIG. 1) is pushed down and forward around a hinge.

Figure 5:
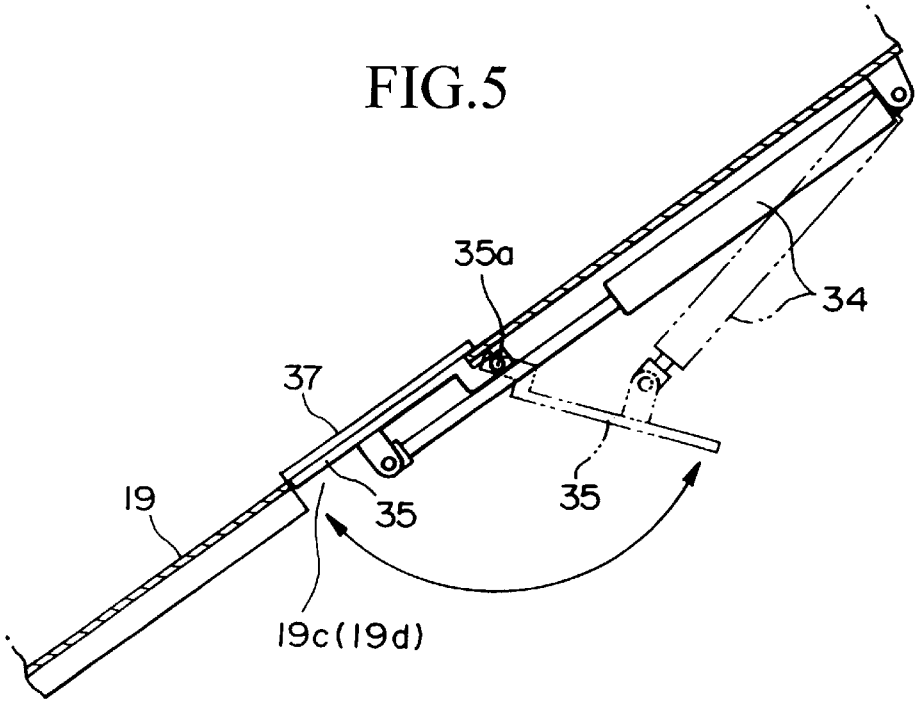
FIG. 5 is a sectional view showing the relationship between a discharge port and a lid in the embodiment of the present invention.

At the middle part of the loading frame 19 between the lower end 19*a* and the discharge end 19*b*, that is, directly above the front hopper 2, are formed two discharge ports 19*c* and 19*d* positioned apart in the longitudinal direction of the loading frame 19. Each of the discharge ports 19*c* and 19*d* is opened and closed, as shown in FIG. 5, by pivoting a lid 35 around a pivot 35*a* by means of a cylinder 34. On opposite sides of the respective discharge ports 19*c* and 19*d* (the portions away from the transfer path for the paving materials Ha and Hb), is attached long narrow stopping plates 37 for preventing the lids 35 from being pivoted excessively upwards.

A stop member 40 for stopping rearward movement of the loading feeder 16 is mounted on a lower face of the loading frame 19, abutting against an abutment member 39 comprising a bolt. The abutment member 39 is adjustably threaded into a nut 41 fixed to the self-propelled vehicle 1, and locked. In this case, since the abutment area of the stop member 40 is wide, then even if due to the slope of the road surface the loading feeder 16 tilts back and forth or from side to side, the abutment member 39 always abuts against the stop member 40.

Figure 6:
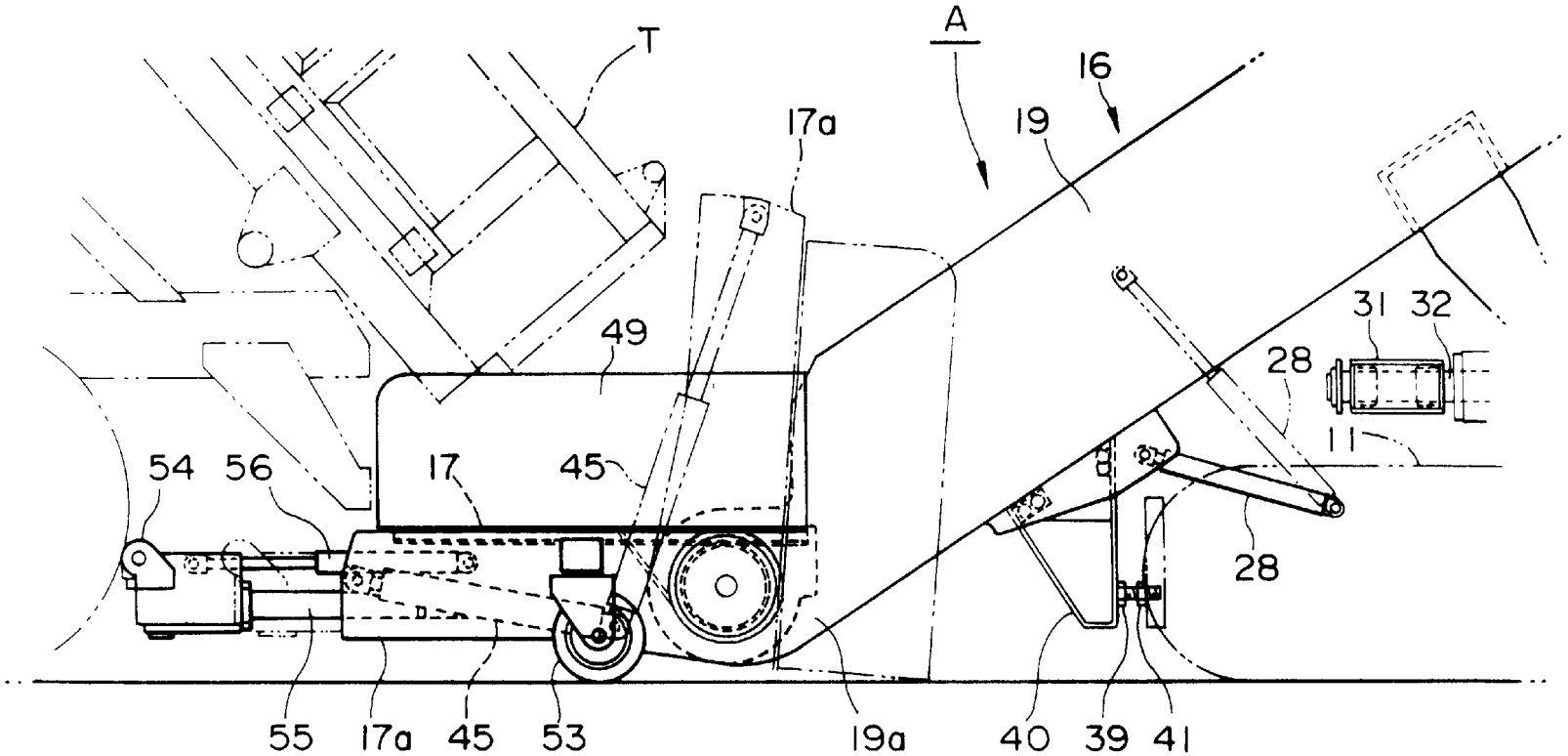
FIG. 6 is a side view showing the relationship between the loading feeder and a receiving hopper in the embodiment of the present invention.

Below a support 17*a* of the receiving hopper 17, a pair of left and right wheels 53 is disposed, so that the load of the receiving hopper 17 (and a supplementary hopper 49 described later) is supported by the wheels 53. Moreover, in front of the support 17*a*, as shown in FIG. 6, a pair of left and right pushing members 54 comprising rollers are supported so as to be movable back and forth by a guide shaft 55. The pushing members 54 are for pushing against the rear wheels of a dump truck T, and the position in the back and forth direction is adjusted by a cylinder 56. Preferably the guide shaft 55 and the cylinder 56 are located on the same plane to prevent generation of a moment due to actuation of the cylinder 56.

Figure 7:
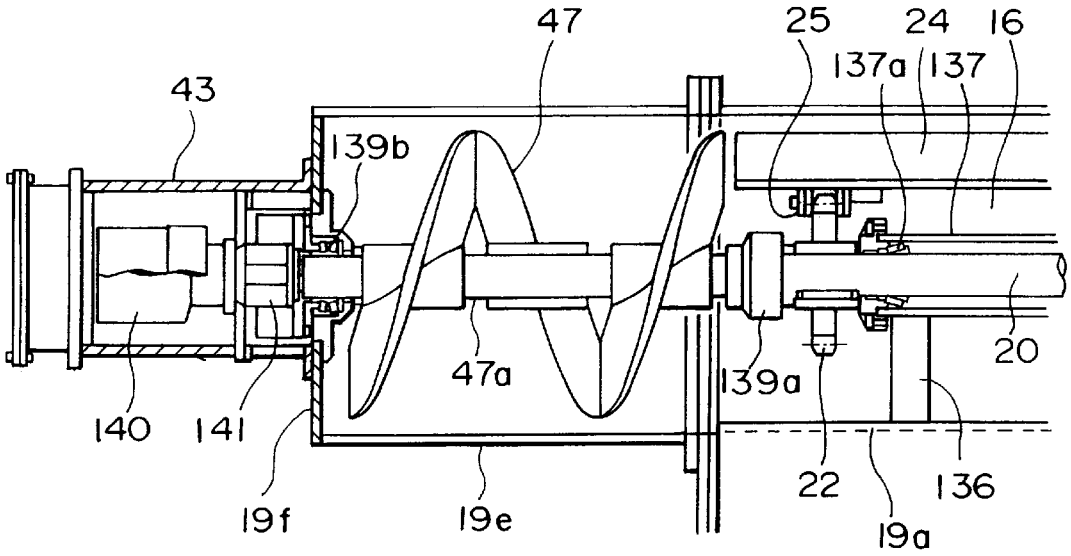
FIG. 7 is a sectional view showing the relationship between a rotation shaft and a screw in the embodiment of the present invention.

A rotation shaft 20 of the loading feeder 16 as shown in FIG. 7, is rotatably supported via a bearing 137*a* inside a cylinder 137 which is horizontally supported by stays 136 extended from the lower end 19*a* of the loading frame 19. The receiving hopper 17 is supported by cylindrical portions 43 of widened portions 19*e* respectively formed on the left and right sides of the lower end 19*a* of the loading frame 19, via ball bearings 44, so as to be pivotal up and down as shown in FIG. 6, by a pair of cylinders 45.

Figure 8:
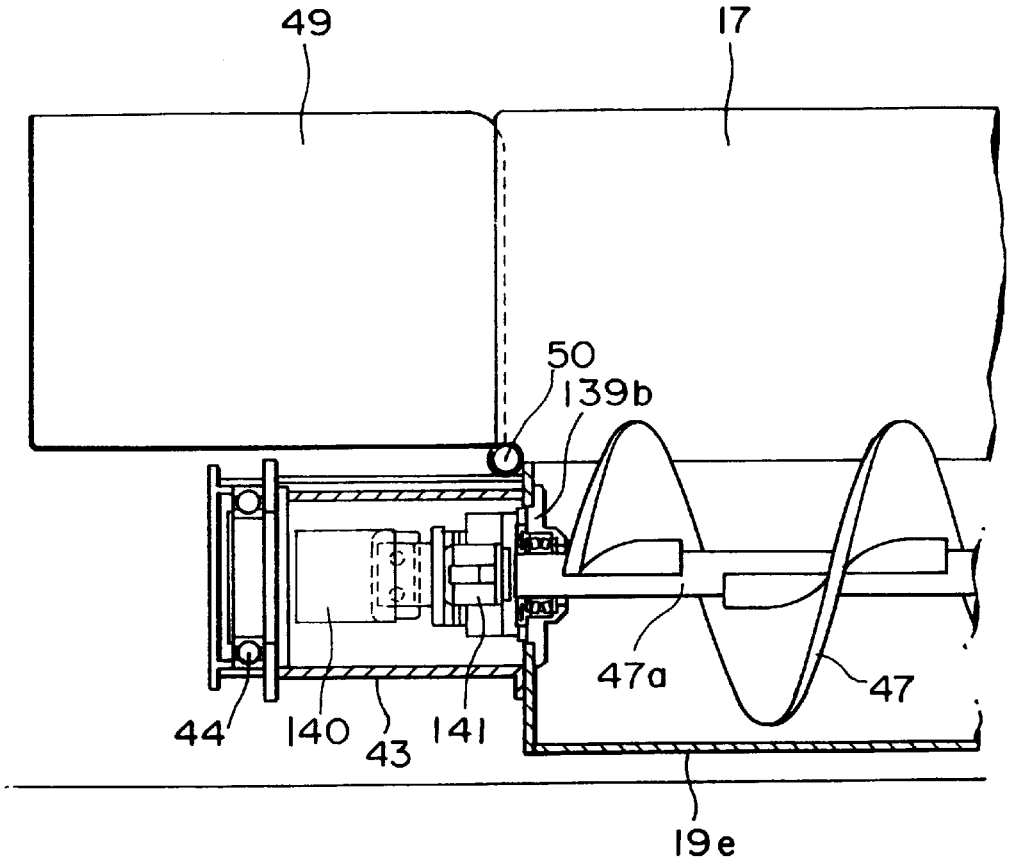
FIG. 8 is a sectional view showing the relationship between the receiving hopper and a supplementary hopper in the embodiment of the present invention.
Figure 9:
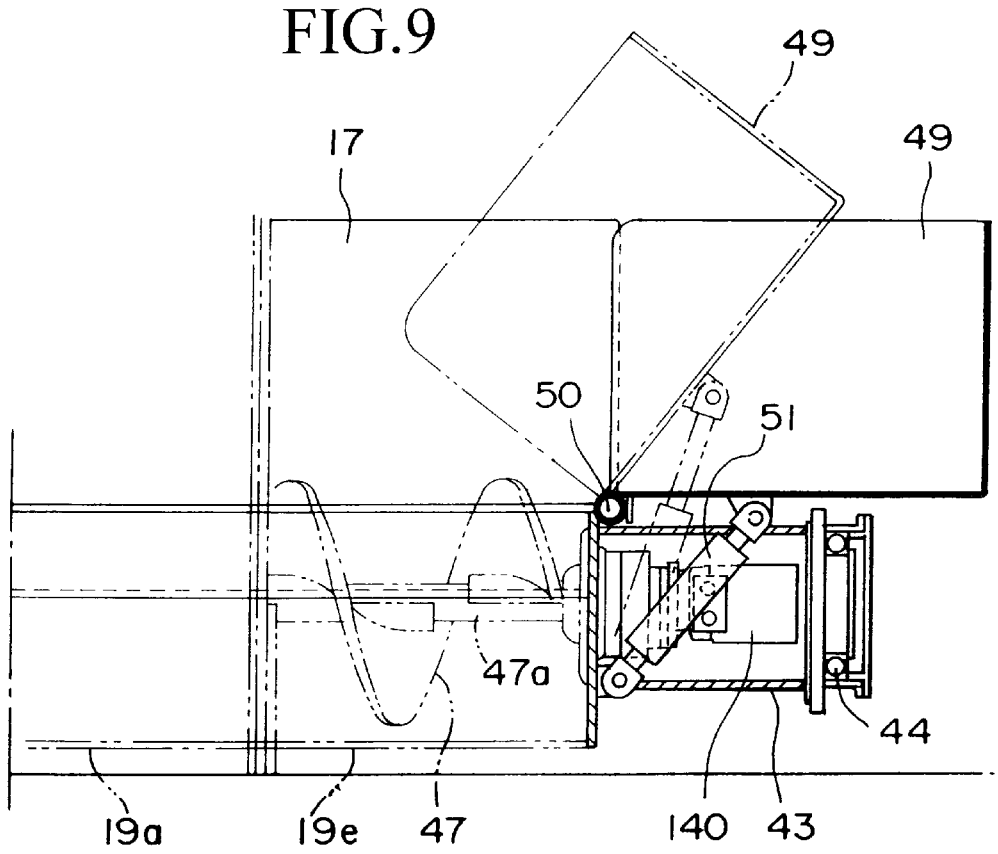
FIG. 9 is a front view showing a fitting arrangement for the supplementary hopper in the embodiment of the present invention.

Screws 47 are respectively disposed in the widened portion 19*e* formed on the left and right sides, as shown in FIGS. 7, 8 and 9. One end of the screw 47 is connected to the end of the rotation shaft 20 via a bearing 139*a*, so as to be rotatable relative thereto, and the other end of the screw 47 is rotatably supported by a blanking plate 19*f* of the widened portion 19*e* via a bearing 139*b*. Moreover, rotation shafts 47*a* of the left and right screws 47 are respectively connected to motors 140 housed inside the cylindrical portions 43, via couplings 141. Hence, it is possible to rotate each of the rotation shafts 47*a* separately to rotate the left and right screws 47 independent of the rotation shaft 20 of the loading feeder 16, so that the paving materials in the widened portion 19*e* are fed toward the endless chain 25. Here, the loading feeder 16 and the screws 47 constitute a conveyor C which transfers the paving materials in the receiving hopper 17 to the front hopper 2 or to the rear hopper 3. Furthermore, the total loading capacity of the front hopper 2 and the rear hopper 3 are enlarged at least the loading capacity of the dump truck T.

Figure 10:
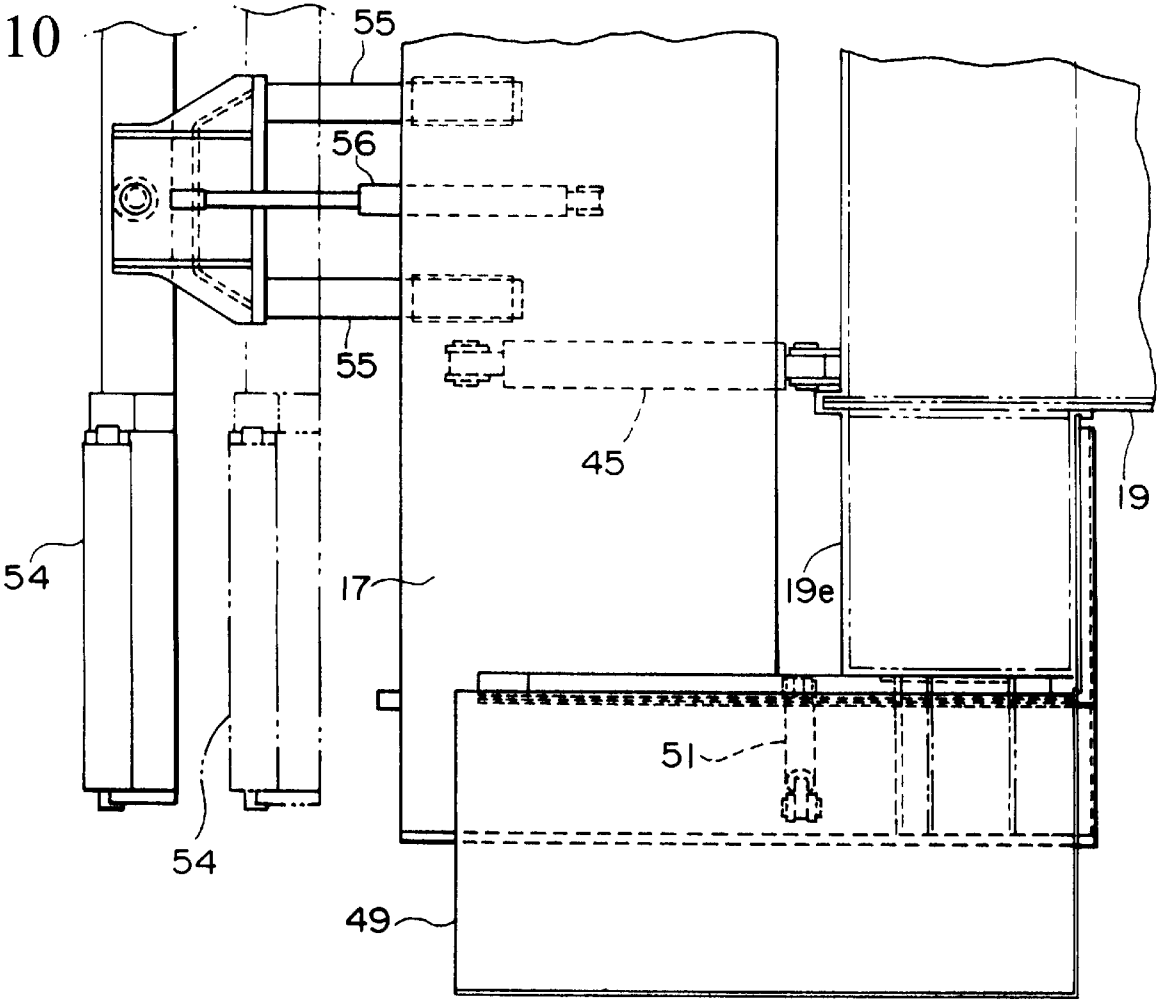
FIG. 10 is a plan view showing the relationship between the receiving hopper and the supplementary hopper in the embodiment of the present invention.

As shown in FIG. 8 and FIG. 9, a supplementary hopper 49 is supported on opposite sides of the receiving hopper 17, so as to be movable up and down about a pivot 50. The supplementary hopper 49 is to make it possible to receive the paving materials from a wide dump truck. As shown in FIG. 9 and FIG. 10, it is possible to fold the supplementary hopper 49 over the receiving hopper 17 by means of a pair of left and right cylinders 51.

The operation of the paving machine having the above construction will now be described.

The solid lines in FIG. 1 show the condition for receiving paving materials. The supplementary hoppers 49 are tilted substantially horizontally next to the sides of the receiving hopper 17, with the loading feeder 16 raised obliquely. In this state, while the dump truck T is being pushed by the pushing member 54 and driven forward together with the self-propelled vehicle 1, the paving materials are dumped into the receiving hopper 17 and the supplementary hopper 49 from the dump truck T. At this time, if the angle of inclination of the loading frame 19 changes due to undulations on the road surface, the loading feeder 16 is guided by the fixed cylinder 31 to freely move back and forth, or to freely tilt from side to side, according to the change of angle, so that the abutment condition of the stop member 40 with the abutment member 39 supported on the self-propelled vehicle 1 can be maintained. Therefore, since the reaction force received by the pushing member 54 which is pushing the dump truck T is acted to the self-propelled vehicle 1 via the stop member 40 and the abutment member 39, the pivot shaft 29 is not subjected to an excessive force.

Then, the left and right screws 47 are respectively rotated by the motors 140, to feed the paving materials in the receiving hopper 17 toward the input side of the loading feeder 16. As a result, the paving materials are effectively transferred into the loading feeder 16 and the amount of the paving materials left in the receiving hopper 17 are reduced. Moreover, since the left and right screws 47 are respectively rotated by the motors 140 which are disposed separately from the motor 27 which is the driving source for the loading feeder 16, the rotation of each screw 47 can be controlled independent of the transfer speed of the loading feeder 16. Furthermore, it is also possible to rotate the left and right screws 47 respectively at different speeds. Hence, if various conditions such as the slope of the road surface in the traveling direction, or the viscosity of the paving materials and the like change, these changes can be quickly accommodated.

Moreover, since the rotation shaft 47*a* of the screw 47 and the rotation shaft 20 on the input side of the loading feeder 16 are connected so as to be rotatable relative to each other via the bearing 139*a*, both rotation shafts can be arranged on the same axis with a simple structure. Hence the supporting structure for both the rotation shafts is simplified.

On the other hand, when there is no need to rotate the screw 47 independent of the loading feeder 16, the rotation shaft 47*a* of the screw 47 can be coupled to the rotation shaft 20 of the loading feeder 16 to make the rotation of the rotation shafts 20 and 47*a* synchronously. In this case, the screw 47 is rotated by the rotation shaft 20 of the loading feeder 16 to feed the paving materials in the widened portion 19*e* to the input side of the loading feeder 16.

The paving materials dumped into the receiving hopper 17 and the supplementary hopper 49 are supplied to the front hopper 2 or the rear hopper 3 by the loading feeder 16. In this case, for example, to put normal paving materials Ha into the front hopper 2, the cylinders 34 are retracted, and the lids 35 are pivoted backward, as shown by the chain line in FIG. 5, to open each discharge port 19*c*, 19*d*, respectively. Then, the motor is operated to rotate the endless chain 25, so that the paving materials Ha scooped by the flights 24 fall from the discharge ports 19*c*, 19*d* into the front hopper 2. Since the discharge ports 19*c*, 19*d* are disposed apart fore and aft, two piles of paving materials are formed in the front hopper 2, adjacent to each other, as the paving materials fall. Hence, the sum of the vertical angles of the plurality of piles becomes larger than the for case with only one pile, so that it is possible to put a larger quantity of the paving materials into the front hopper 2.

On the other hand, for example, to put paving materials Hb having high durability into the rear hopper 3, each of the discharge ports 19*c*, 19*d* is closed by the lids 35, as shown by the solid line in FIG. 5 so that the paving materials Hb in the receiving hopper 17 and the supplementary hopper 49 are transferred to the discharge end 19*b* by the loading feeder 16 to fall into the rear hopper 3.

As a result, according to the present invention, the paving materials Ha and Hb dumped in the receiving hopper 17 from the dump truck T or the like can be easily carried to two different positions by opening and closing the discharge ports 19*c* and 19*d*. Furthermore, a dedicated dump truck T or the like is not required.

Moreover, because of the total loading capacity of the front hopper 2 and the rear hopper 3 are enlarged at least the loading capacity of the dump truck T, the paving materials which loaded the dump truck T are wholly transferred to the hopper 2,3 at a time. Hence, after the loading of the paving materials by the dump truck T, the paving machine can be operated apart from the dump truck, and a turnover rate of the dump truck T is improved. Therefore, a time of the paving machine for waiting the dump truck T is decreased, and operating efficiency of the paving machine is improved.

Furthermore, since supplementary hoppers 49 are disposed on the left and right sides of the receiving hopper 17, such that they can be housed in the receiving hopper, the volume of the paving materials Ha and Hb to be received therein increases by the volume of the supplementary hoppers 49. Hence it becomes possible to receive the paving materials Ha and Hb from a wide dump truck T. Moreover, by housing the supplementary hoppers 49 in the receiving hopper 17, the width of the loading apparatus at the time of non-use is reduced. Furthermore, if the loading feeder 16 is formed by providing a tensioned endless chain 25 having flights 24, between the sprockets 22 and 23 respectively disposed at the lower end 19*a* and the discharge end 19*b* of the loading frame 19, the paving materials are not only transferred accurately by the flights 24, but also the structure of the loading feeder 16 is simplified and damages are minimized.

When the amount of the paving materials left in the supplementary hopper 49 decrease, the supplementary hopper 49 is inclined by the cylinder 51 to facilitate the fall of the paving materials into the widened portion 19*e*. It is also possible to facilitate the movement of the paving materials toward the loading feeder 16 by inclining the receiving hopper 17 by means of the cylinders 45.

The paving materials Ha loaded to the front hopper 2 are transferred to in front of the front spreading screw 5 by the bar feeder 4 and spread horizontally by the front spreading screw 5, and then laid and paved by the front screed 8. In addition, the paving materials Hb supplied to the rear hopper 3 are made to fall from a drop port of the rear hopper 3 onto the rear spreading screw 7, and after being spread horizontally by the rear spreading screw 7, the paving materials Hb are paved on the paving materials Ha by the rear screed 9.

When the paving machine is deadheaded to other paving sites, the supplementary hoppers 49 are placed on top of the receiving hopper 17 by means of the cylinders 51, and the receiving hopper 17 is pivoted toward the loading feeder 16 by the cylinders 45. Moreover, as shown by the chain line in FIG. 1, the loading feeder 16 is tilted to substantially horizontal by the pivoting cylinder 28. Thereby, the overall length of the paving machine is reduced, and the height is lowered. Furthermore, since the wheels 53 are provided on the receiving hopper 17 for taking the load of the receiving hopper 17, there is no need to mount the receiving hopper 17 on the self-propelled vehicle 1, thus preventing the self-propelled vehicle 1 from becoming too long or large. It is also contributing to make the paving machine smaller that the engines $E_1$, $E_2$ are positioned at the left and right sides of the loading feeder 16.

All the operations relating directly or indirectly to paving and laying of the paving materials Ha and Hb, including driving of the self-propelled vehicle 1, are controlled by a driving apparatus B disposed so as to be movable up and down, at the rear end of the rear hopper 3. The construction and the operation of the driving apparatus B will now be described with reference to FIG. 11 through FIG. 18.

The driving apparatus B typically comprises a pair of left and right vertical rails 222, a floor 223 connected to the vertical rails 222 so as to be freely movable up and down, operating equipment such as a switchboard 224, a control box 225, an instrument box 226, and driving equipment such as a steering wheel 227 disposed on the floor 223, a pair of left and right driving seats 228, and an elevating apparatus 229 for elevating the floor 223.

Figure 11:
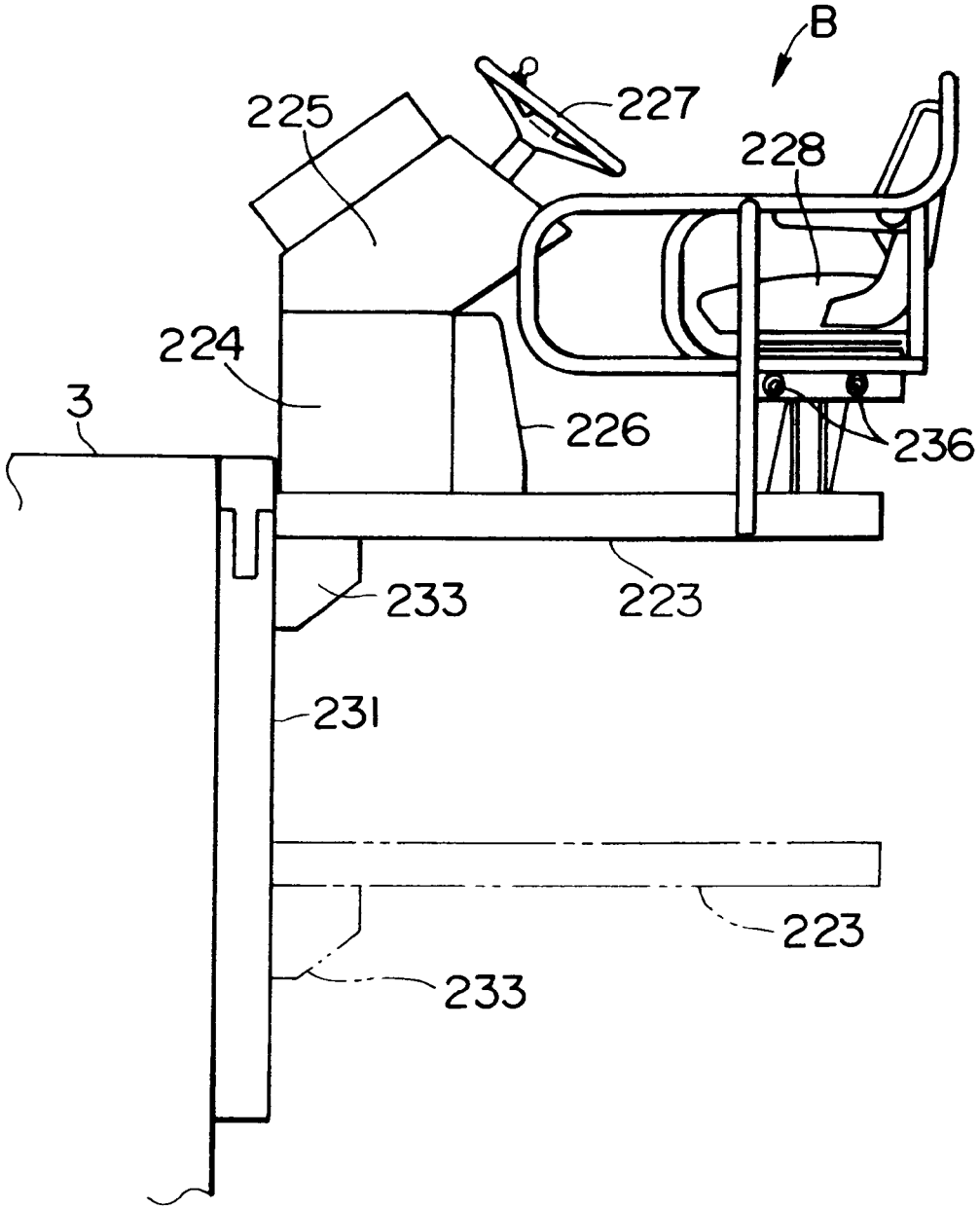
FIG. 11 is a side view of a driving apparatus in the embodiment of the present invention.
Figure 12:
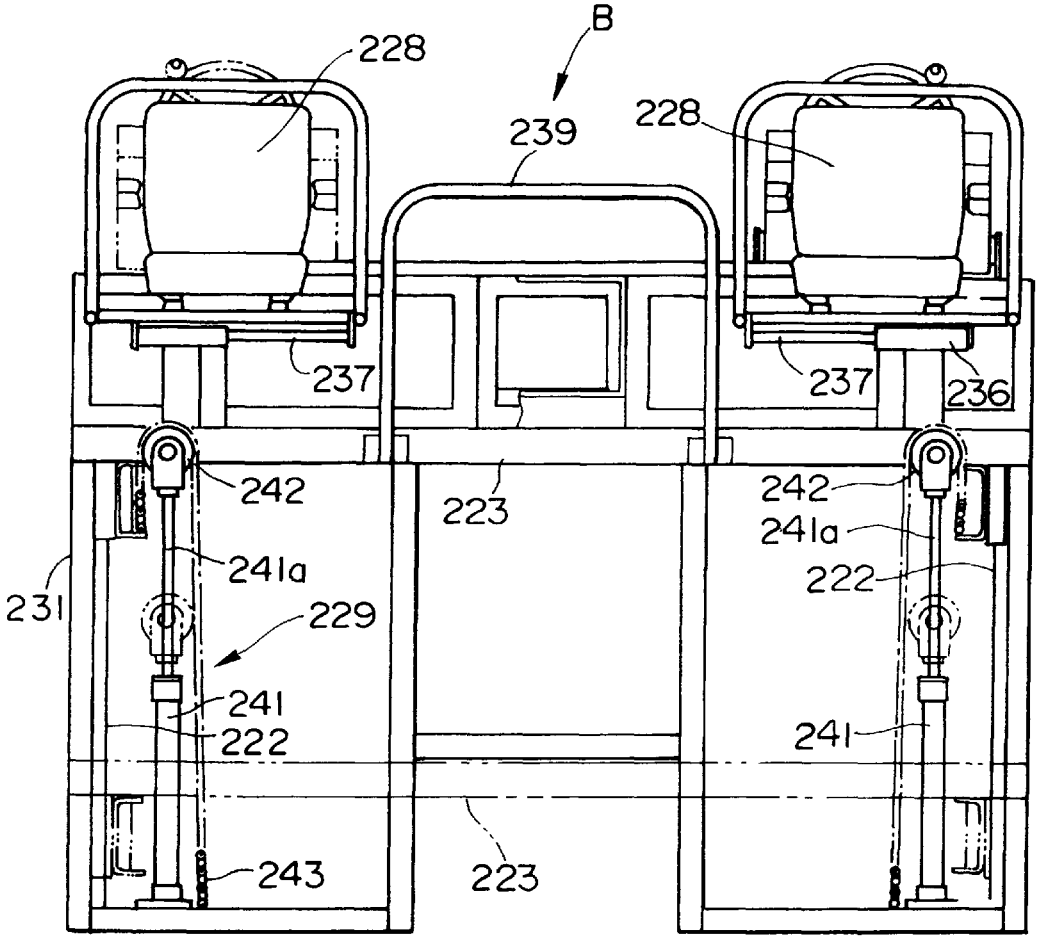
FIG. 12 is a rear view of the driving apparatus shown in FIG. 11.
Figure 13:
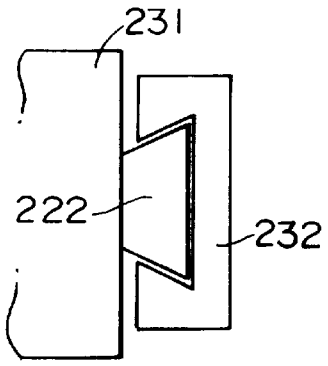
FIG. 13 is a schematic illustration showing the relationship between a vertical rail and a vertical member in the driving apparatus shown in FIG. 11.

The individual vertical rails 222 have a dovetail section, and as shown in FIG. 12, are mounted vertically on opposing side faces of a pair of lift frames 231 arranged in an upright condition on a rear wall of the rear hopper 3. Moreover, as shown in FIG. 13, vertical members 232 having dovetail grooves are respectively engaged with the vertical rails 222, and as shown in FIG. 11, the floor 223 is supported horizontally on the vertical members 232, via brackets 233.

Figure 14:
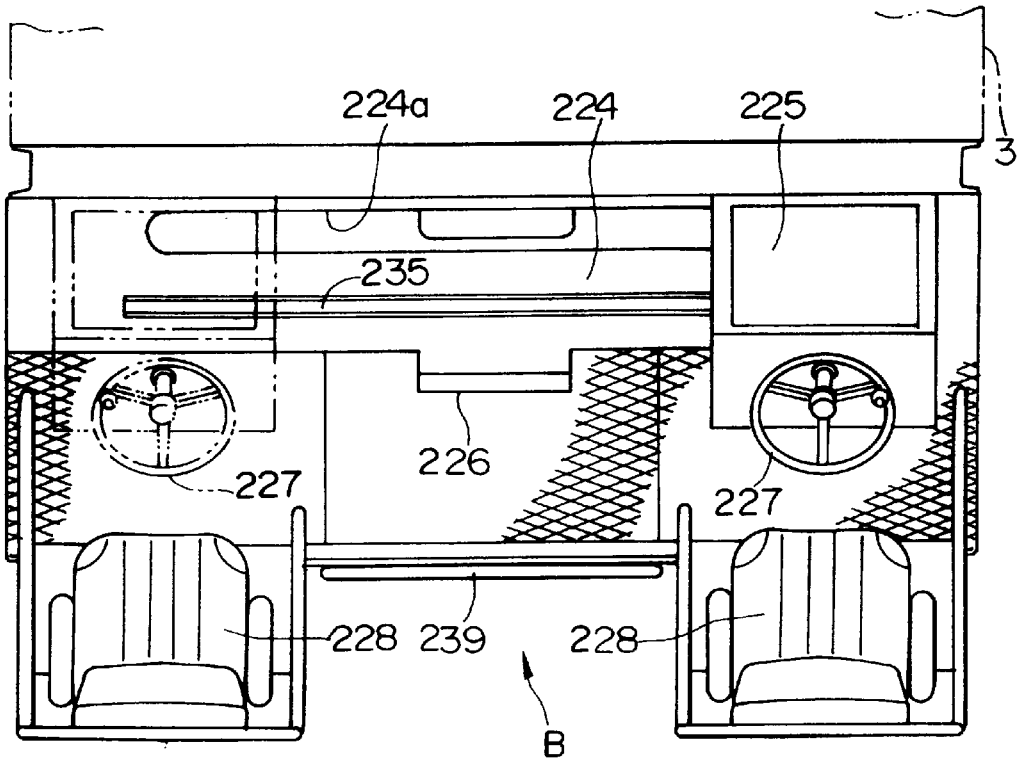
FIG. 14 is a plan view of the driving apparatus shown in FIG. 11.

The floor 223 is formed, as shown in FIG. 14, from a mesh metal. On the switchboard 224 disposed on the front part of the floor 223, the control box 225 and the steering wheel 227 are disposed so as to be movable from side to side along a horizontal rail 235 having a dovetail section. Moreover, wiring and the like for connecting the switchboard 224 to the control box 225 and the steering wheel 227 are pulled out upward from a lengthwise slot 224*a* disposed on the switchboard 224 and connected to the control box 225 and the like.

Figure 15:
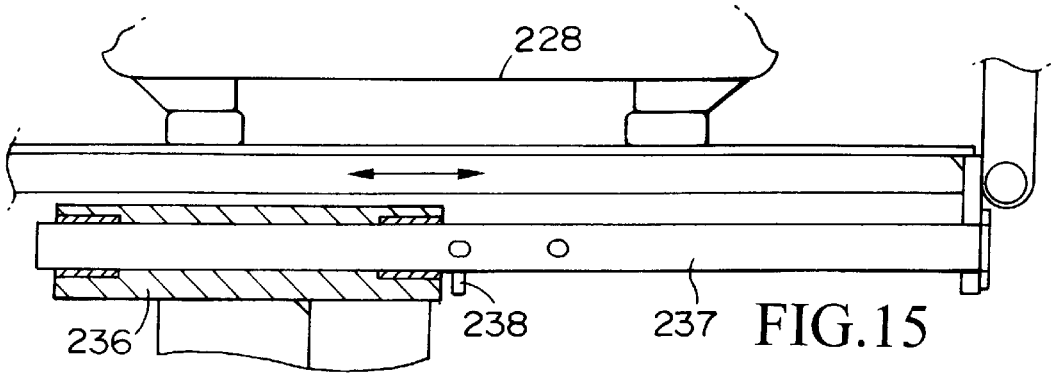
FIG. 15 is a sectional view showing the relationship between a cylindrical member and a supporting rod in the driving apparatus shown in FIG. 11.
Figure 16:
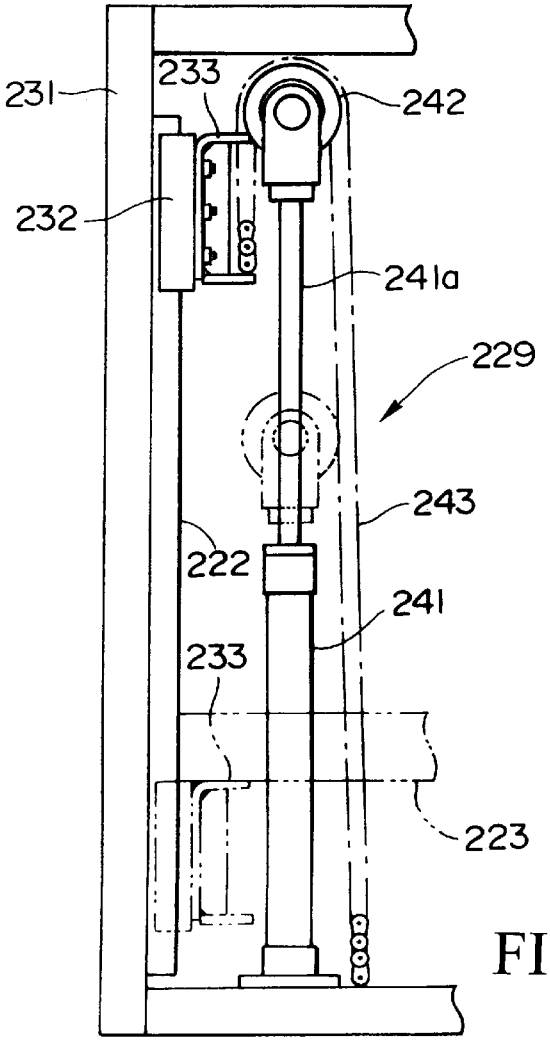
FIG. 16 is a front view of an elevating apparatus in the driving apparatus shown in FIG. 11.

The driving seats 228 as shown in FIG. 12, are provided in line so as to be movable from side to side at the rear part of the floor 223, by inserting supporting rods 237 on which the driving seats 228 are respectively supported, through pairs of front and rear cylindrical members 236 fixed parallel with the floor 223. As shown in FIG. 15, the driving seats 228 are fixed relative to the floor 223 by attaching pins 238 to the supporting rods 237. Moreover, a handrail 239 is provided at the center of the rear part of the floor 223 so as to be freely opened and closed, to assist the operator in coming onto and going off the floor.

The elevating apparatus 229 comprises a pair of elevating cylinders 241, sprockets 242 and chains 243. The elevating cylinders 241 are arranged upright at the lower part of the lift frame 231, and the sprockets 242 are rotatably supported on the upper ends of piston rods 241*a* of the elevating cylinders 241. Moreover, the chains 243 are wrapped around the sprockets 242 and folded back downward, with one lower end of the chains 243 being fixed to the lower parts of the lift frames 231, and the other lower ends of the chains 243 being fixed to brackets 233 (see FIG. 16 and FIG. 17).

When the sprockets 242 are raised by the elevating cylinders 241, the floor 223 is raised via the chains 243 and the brackets 233, when the sprockets 242 are lowered , the floor 223 is also lowered. In this case, since the chains 243 are folded back downward around the sprockets 242, the moving distance of the floor 223 in the vertical direction becomes twice the vertical stroke of the sprockets 242.

A hydraulic circuit for the elevating cylinder 241 as shown in FIG. 18, is equipped with a pilot operated check valve 245. The pilot operated check valve 245 serves to stop the outflow of the actuation oil from a lower chamber 241*b* of the elevating cylinder 241 normally, and when the actuation oil is supplied to an upper chamber 241*c*, to freely allow the outflow of the actuation oil from the lower chamber 241*b* due to the pressure of the actuation oil. Here the pair of elevating cylinders 241 are extended and retracted synchronously with each other by means of a synchronous circuit.

The operation of the driving apparatus B having the above construction will now be described.

First, the elevating cylinders 241 are retracted to lower the floor 223, and the operator sits on either one of the driving seats 228 appropriate for the leveling operation. The elevating cylinders 241 are normally extended or retracted by button operation, operating buttons being provided on both the floor 223 and the self-propelled vehicle 1.

The operator sitting on the driving seat 228 first elevates the floor 223 by extending the elevating cylinder 241, moves the control box 225 and the steering wheel 227 to a desired position and then drives the machine to lay and pave the paving materials Ha and Hb. In this case, since the driving seat 228 is in a high position, the operator can have a good front view, and as a result, can properly grasp the situation in front, for example, the presence or absence of workers, the state of the road surface, the situation of the paving materials to be received from a dump truck T into the receiving hopper 17, the operation state of the loading feeder 16 and the like.

Furthermore, the driving seat 228, the control box 225 and the steering wheel 227 are moved from side to side, as required. As a result, for example, even if the loading feeder 16 obstructs the view, this situation can be avoided. Moreover, the operator can thrust his body across to easily determine the situation of the vehicle sides or the paving situation.

When the operator comes down from the driving seat 228 after completing the paving operation, the elevating cylinders 241 are retracted to lower the floor 223. Therefore, with the driving apparatus B, the getting on and off of the operator is easier than for the case using a ladder, and the operating burden on the operator can be reduced.

When the paving machine is deadheaded on a trailer, then as shown by the chain line in FIG. 1, the driving apparatus B is lowered and shifted at the rear part of the rear hopper 3. Hence, when the paving machine is deadheaded, the driving apparatus B does not prove a hindrance. In some cases, the floor 223 may be stopped in the mid vertical position to perform the paving operation.

Furthermore, since elevating cylinders 241 with a short extension/retraction stroke are used, the structure is simplified, resulting in a cost reduction. Moreover, since the driving apparatus B is disposed on the rear wall of the rear hopper 3, the rear wall of the rear hopper 3 can be effectively and reasonably utilized to give a cost reduction.

Instead of the paving machine shown in FIG. 1, the driving apparatus B may be mounted for example on a paving machine disclosed in the above described Published Japanese Translation No. Hei 9-505370 which does not have the loading feeder 16 and the receiving hopper 17, or on a conventional large asphalt finisher having only one set of a hopper and a screed, to obtain a similar effect.

With the above described embodiment, one which mounts a conveyor C in the receiving hopper 17 has been taken and described as an example. However, the present invention is not limited to this example, and is also applicable to a bar feeder which feeds the paving materials from the front hopper toward the rear. Moreover, the machine to which the conveyor C of the present invention is applied, is not limited to a paving machine.

Second Embodiment

Another embodiment of the present invention will now be described with reference to FIG. 19 through FIG. 22. This embodiment particularly relates to an improvement of the front screed 8 and the rear screed 9 of the paving machine shown in FIG. 1.

Figure 19:
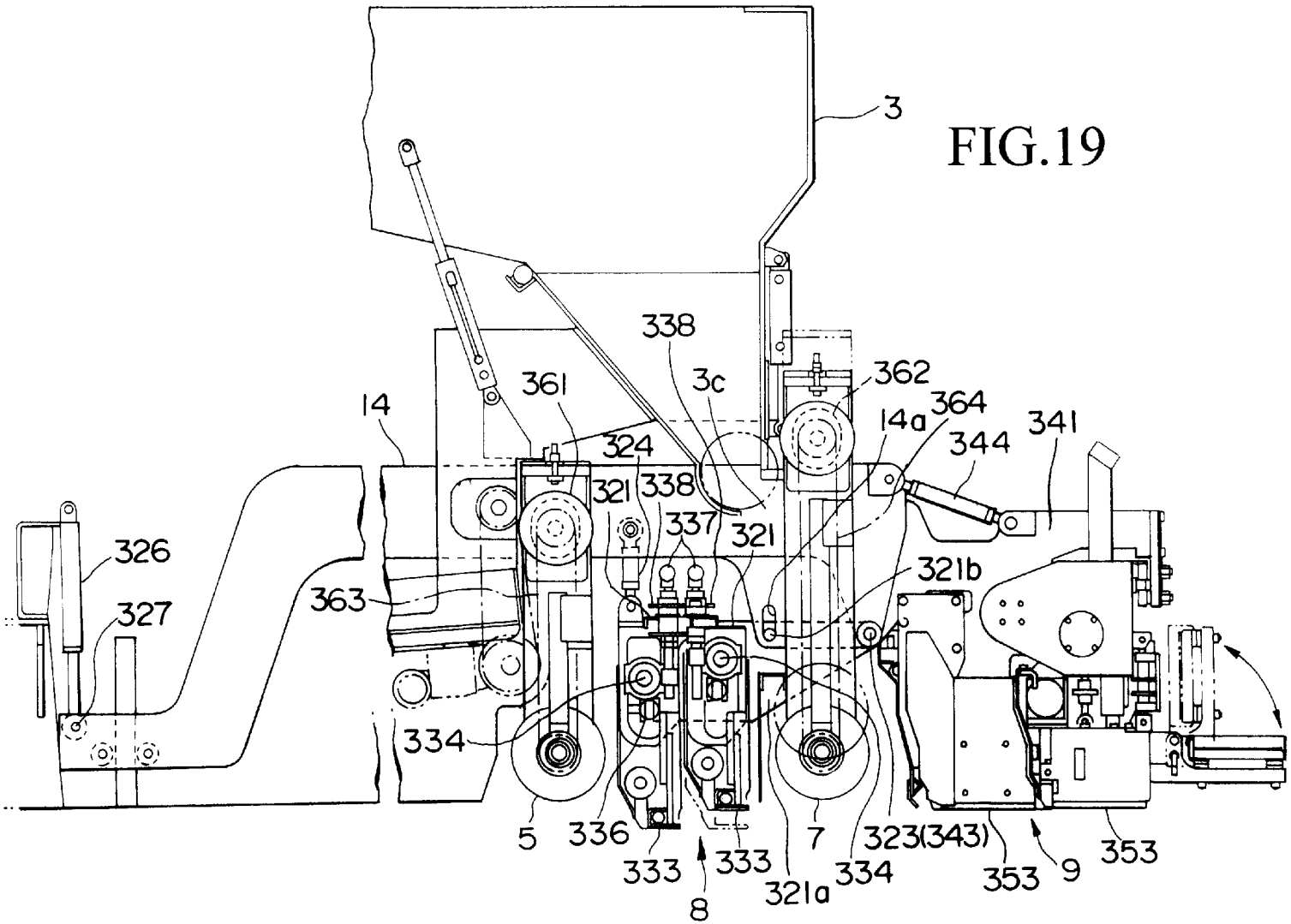
FIG. 19 is a side view showing the relationship between a front screed and a rear screed in the embodiment of the present invention.
Figure 20:
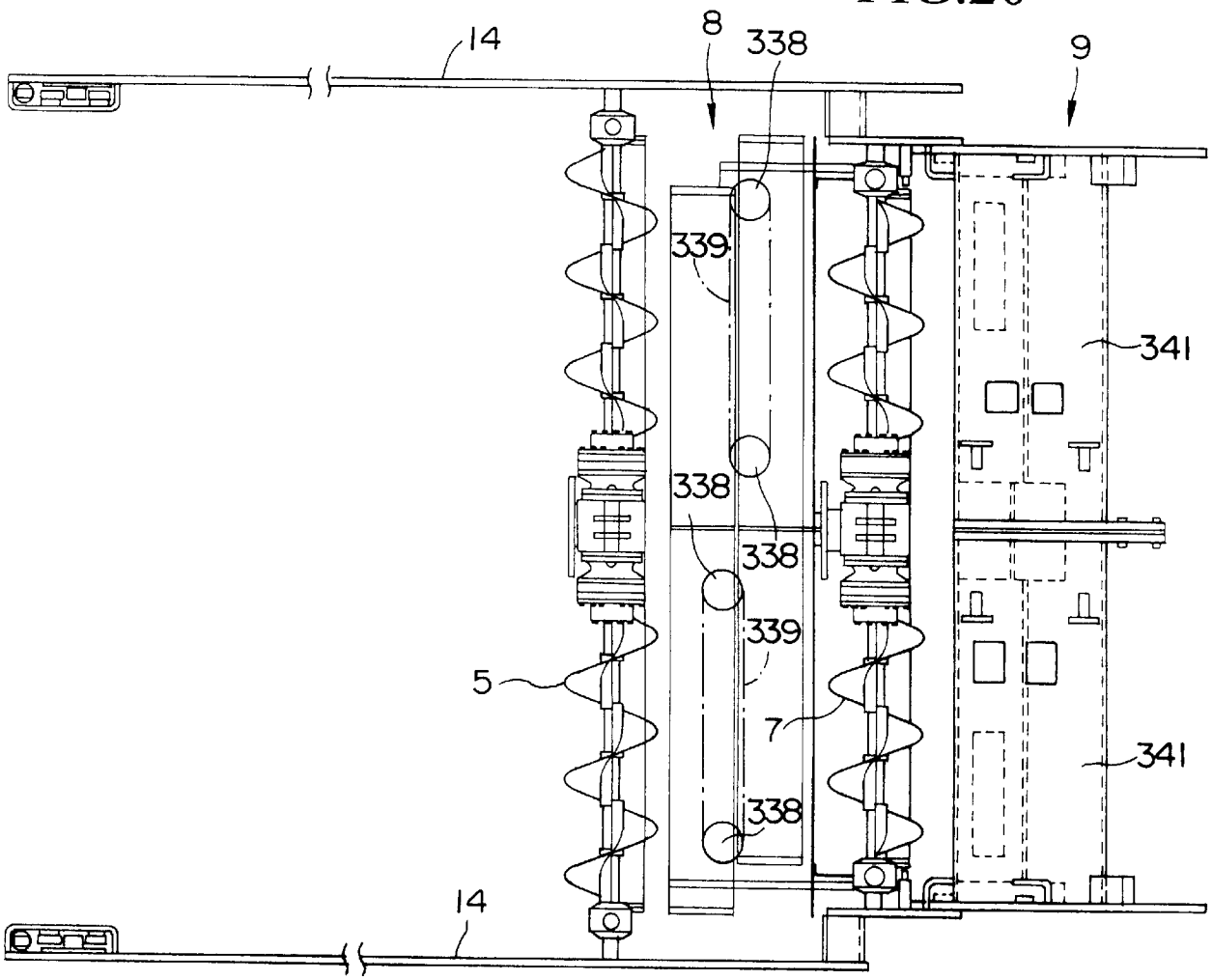
FIG. 20 is a plan view showing the relationship between the front screed and the rear screed in the embodiment of the present invention.

Reference number 321 denotes a pair of left and right frames. Respective arms 321*a* of the frame 321 (see FIG. 19) are supported on a pair of left and right leveling arms 14, so as to be pivotal up and down about pivot shafts 323. The front parts of the frames 321 are respectively connected to the leveling arms 14 by turn buckles 324. As a result, the frames 321 are suspended at the longitudinal middle part of the leveling arms 14, that is, between the front spreading screw 5 and the rear spreading screw 7. The forward ends of the leveling arms 14 as shown in FIG. 19, are connected to lower ends of cylinders 326 suspending down from the self-propelled vehicle 1, via pivot shafts 327. As a result, the leveling arms 14 can be pivoted up and down about the pivot shafts 323, by retraction of the cylinders 326.

Figure 21:
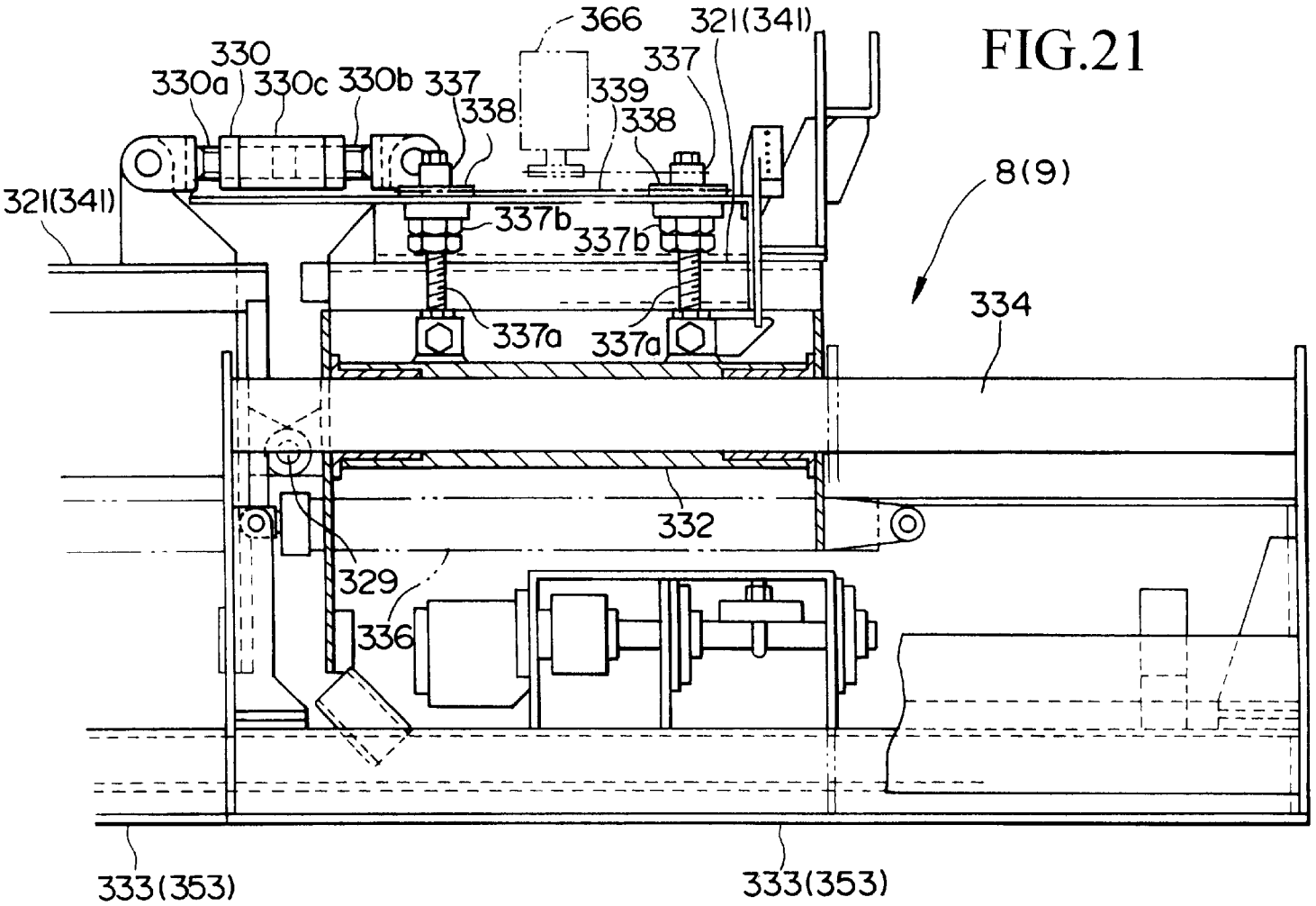
FIG. 21 is a sectional view of the front screed in the embodiment of the present invention.
Figure 22:
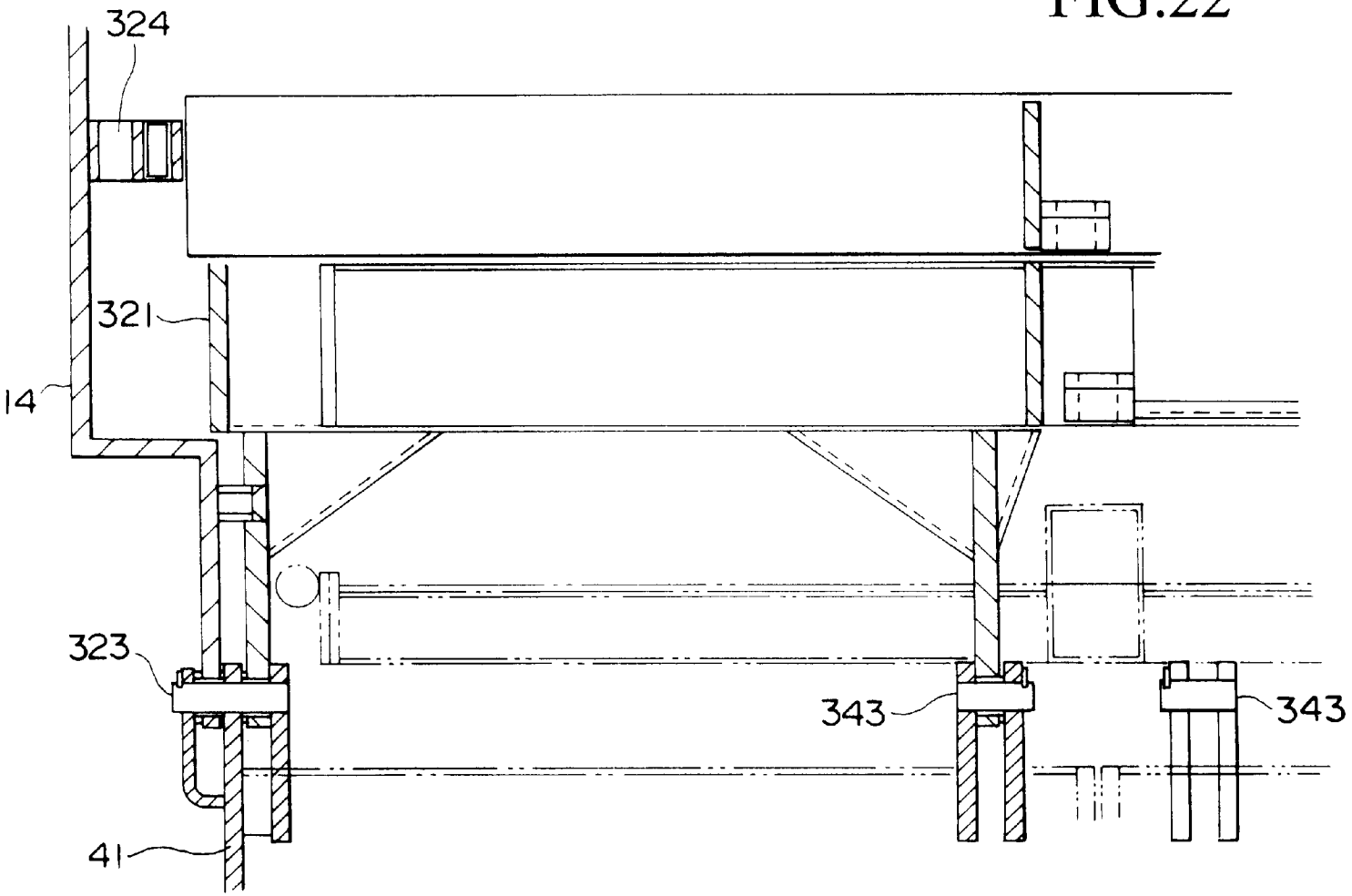
FIG. 22 is a view showing a connection structure for frames of the front screed and the rear screed in the embodiment of the present invention.

As shown in FIG. 21, the left and right frames 321 are connected by a connecting shaft 329 extending fore and aft at a vertically central part, and can be inclined vertically about the connecting shaft 329. Moreover, the upper parts of the frames 321 are connected to each other by a spacing adjustment mechanism 330. The spacing adjustment mechanism 330 is for adjusting the angle of inclination of the frames 321 about the connecting shafts 329, by changing the spacing between the frames 321. Concretely, an extensible/retractable turnbuckle is used, which is formed by screwing a nut 330*c* onto screw shafts 330*a* and 330*b* which have mutually opposite threads.

Each frame 321 is provided with fixed guide members 332 (see FIG. 21), positioned apart from each other in the fore and aft direction, and substantially horizontal. Movable guide members 334 with screed plates 333 attached to their lower ends, are respectively inserted into each fixed guide member 332, with the screed plates 333 positioned apart in the fore and aft direction. The movable guide members 334 are moved sideways relative to the fixed guide members 332 by extension and retraction of cylinders 336, resulting in a change in the paved width.

Each fixed guide member 332 is respectively attached to the frame 321 so as to be movable up and down, by means of a pair of left and right vertical mechanisms 337. The vertical mechanisms 337 are formed by screwing screws 337*a* attached to the fixed guide member 332 into nuts 337*b* rotatably attached to the frame 321. Sprocket 338 are respectively fixed to the screws 337*a* so that when one of the screws 337*a* is rotated, the other screws 337*a* rotates via a chain 339 wrapped between the sprockets 338, and the fixed guide member 332 thus moves up or down together with the movable guide member 334 and the screed plate 333. The front screed 8 is thus constituted by the above described construction. As shown in FIG. 21, the vertical mechanism 337 may be driven by a motor 366 supported on the frame 321, via a transmission mechanism such as a chain or the like.

Reference number 341 denotes a pair of left and right frames disposed rearward of the frame 321. The front parts of the frames 341 are supported on the leveling arm 14 by pivot shafts 323, similarly to the frame 321 of the front screed 8, and are also supported on the frame 321 by a pivot shaft 343 coaxial with the pivot shaft 323 (see FIG. 22). Moreover, the upper part of the frame 341 is connected to the rear end of the leveling arm 14 by a turn buckle 344. As a result, the frame 341 is suspended towards the rear of the rear spreading screw 7. Other construction is basically the same as for the front screed 8. The rear screed 9 is thus constituted by the above described construction.

Also with the rear screed 9, it is possible to extend and retract a screed plates 353 positioned apart in the fore and aft direction so as to change the paved width, to change the angle of inclination of the screed plates 353, and to move each screed plate 353 up and down relative to the frame 341.

In this case, since the respective frames 321 and 341 of the front screed 8 and the rear screed 9 are connected to each other by the pivot shafts 323 and 343, pivoting of the respective screed plates 333, 353 of the front screed 8 and the rear screed 9 about the connecting shaft 329 is relatively interlocked. Therefore, the spacing adjustment mechanism 330 of either one of the front screed 8 and the rear screed 9 (typically, of the front screed 8) can be omitted to simplify the construction and the operation of the screeds 8 and 9. On the other hand, when the spacing adjustment mechanism 330 is provided on both the front screed 8 and the rear screed 9, the connecting shafts 343 may be omitted without any problem.

As shown in FIG. 19, a drop port 3*c* for the paving materials in the rear hopper 3 is located above the rear spreading screw 7 so that the paving materials fall from the drop port 3*c* onto the rear spreading screw 7 under their own weights. Moreover, respectively connected to the spreading screw 5 and 7, are motors 361, 362 for rotating the spreading screws 5 and 7, via respective transmission devices 363 and 364 such as chains or the like. Furthermore, reference number 321*b* in FIG. 19 denotes a roll preventing pin disposed in the arm 321*a*. The pin 321*b* is inserted into an elongate hole 14*a* in the leveling arm 14, to prevent rolling of the front screed 8.

The operation of the paving machine having the above construction will now be described, centering on the operation of the front screed 8 and the rear screed 9.

With the paving materials paving operation, while the self-propelled vehicle 1 is being moved, for example normal paving materials Ha in the front hopper 2 are transferred to the front of the front spreading screw 5 by the bar feeder 4, spread to the side by rotation of the spreading screw 5, and laid and paved by the screed plates 333 of the front screed 8. At the same time, the paving materials Hb, for example having excellent durability, in the rear hopper 3 are spread to the side by rotation of the rear spreading screw 7, and laid and paved on the paving materials Ha by the screed plates 353 of the rear screed 9. In doing this, both the screeds 8 and 9 are moved up and down pivoting about the pivot shaft 327, and hence there is almost no change in the height difference between them, thus making the paved thickness of the paving materials Hb uniform.

Furthermore, supply of the paving materials Hb to the rear spreading screw 7 are effected by simply letting the paving materials Hb fall from the drop port 3*c* of the rear hopper 3 under gravity. Hence, the feeder is not required thus making the construction simple, reducing operating costs.

In the paving operation, when the paved thickness of the paving materials Hb are to be changed, the front screed 8 is moved up and down relative to the rear screed 9 by the two pairs of vertical mechanisms 337 (four in total), or the rear screed 9 is moved up and down relative to the front screed 8 by the vertical mechanisms (having the same structure as the vertical mechanisms 337) of the rear screed 9, to thereby adjust the height difference between the respective screed plates 333 and 353 of the two screeds 8 and 9. In this case, it is possible to change the paved thickness of the paving materials Hb by moving one of the screeds 8 and 9 upward and the other downward, or to change the paved thickness of the paving materials Hb by changing the vertical movement amount of the two screeds 8 and 9. Therefore, according to this embodiment, the paved thickness of the paving materials Hb of the upper layer can be accurately controlled, enabling optimum paving to be performed. On the other hand, the paved thickness of the paving materials Ha are changed, as heretofore, by changing the angle of attack of the screeds 8 9.

Furthermore, when the paved width of the paving materials are changed, the change is effected by extending or retracting the respective screed plates 333 and 353 of the screeds 8 and 9 by the cylinders (the cylinder 336 in the case of the front screed 8). The adjustment of the paving crown angle is effected by changing the angle of inclination of the screed plates 333, 353 by the spacing adjustment mechanism (the spacing adjustment mechanism 330 in the case of the front screed 8). Hence, according to this embodiment, the paved width and the paving crown angle can be easily adjusted.

This embodiment may be modified from the example shown in the drawings, for example, as described below.

(1) Either one or both of the screeds 8 and 9 are made with a construction which cannot be extended or retracted. In this case, the paved width is changed by attaching and detaching a supplementary screed to the screed.

(2) The screed plates 353 located in front of the rear screed 9 are fixed screed plates constructed integrally with each frame 341, and a pair of extensible/retractable screed plates 353 supported on each frame 341 are disposed to the rear thereof, so that the extensible/retractable screed plates 353 can be extended or retracted freely in the widthwise direction.

(3) The paving materials Hb of the rear hopper 3 are transferred to the rear spreading screw 7 by the bar feeder, similarly to with the front hopper 2.

(4) Two kinds of paving materials Ha and Hb are spread adjacent to each other in the horizontal direction without being overlapped. In this case, both the screeds 8 and 9 are set to the same height to lay and pave the paving materials Ha and Hb.

(5) The vertical mechanism 337 is so formed as to be moved up and down by turn buckles, with a pair of turn buckles connected by a chain and a sprocket.

Third Embodiment

Figure 23:
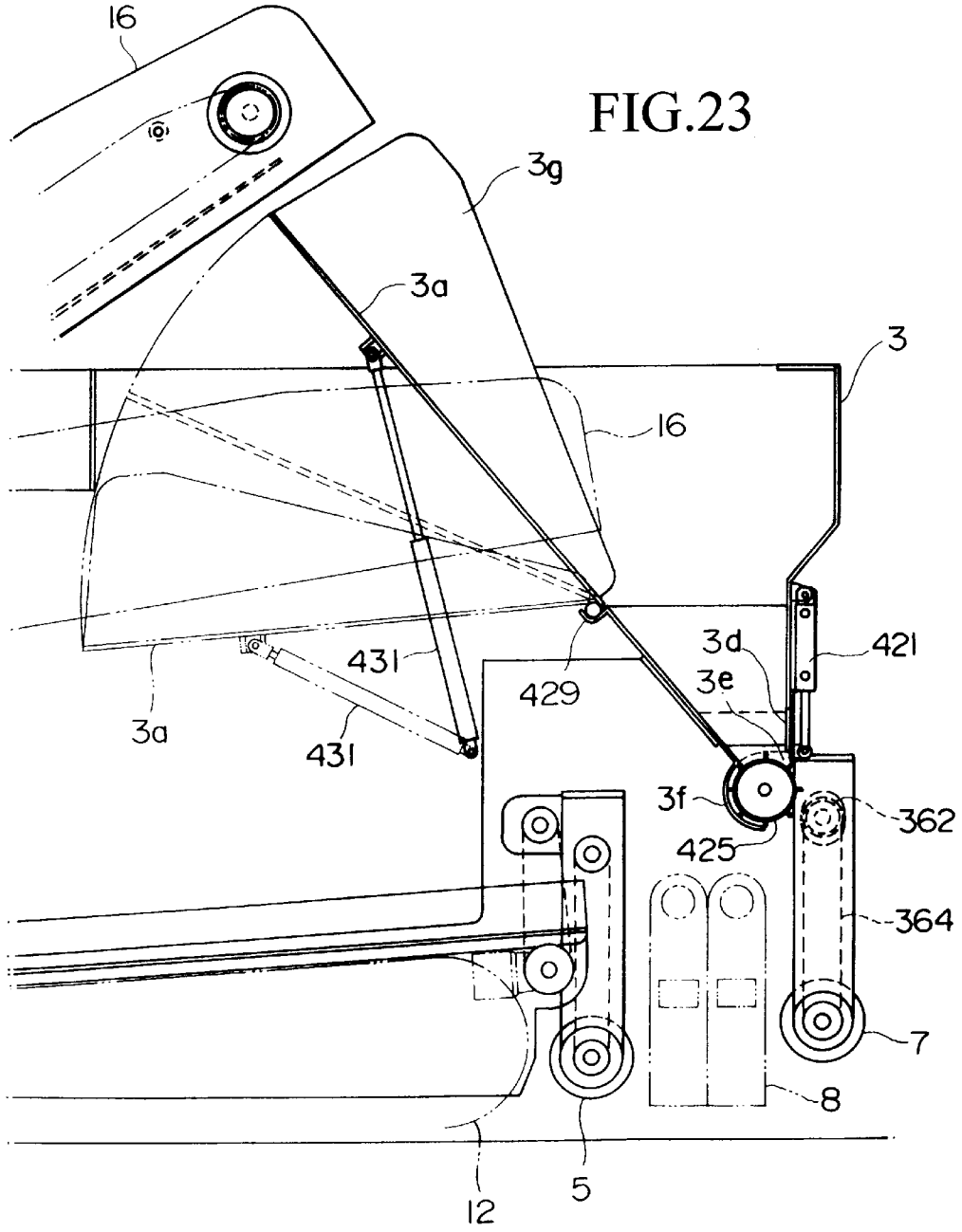
FIG. 23 is a sectional view of a hopper for paving materials, in the embodiment of the present invention.
Figure 24:
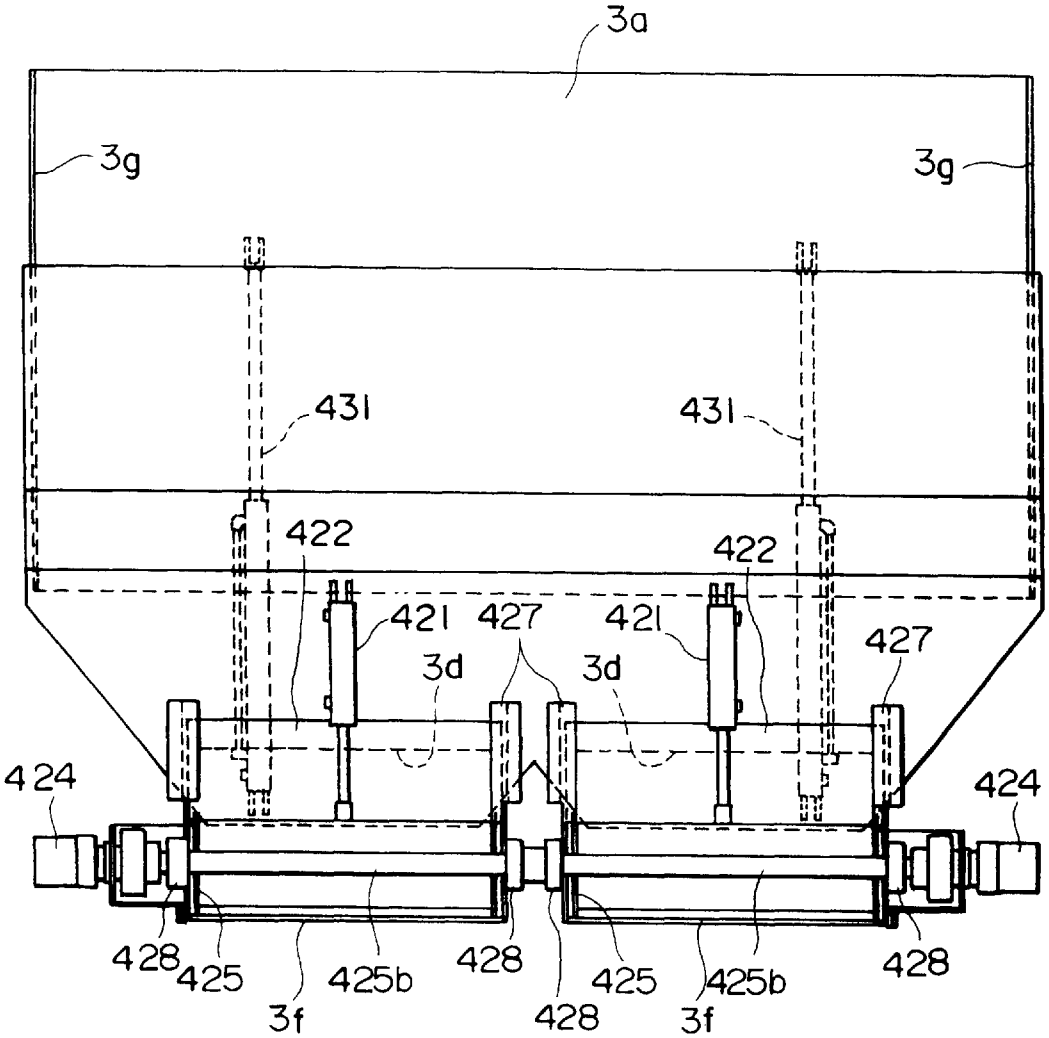
FIG. 24 is a sectional view of the hopper shown in FIG. 23, showing a structure on the rear side of a rotation roll.
Figure 25:
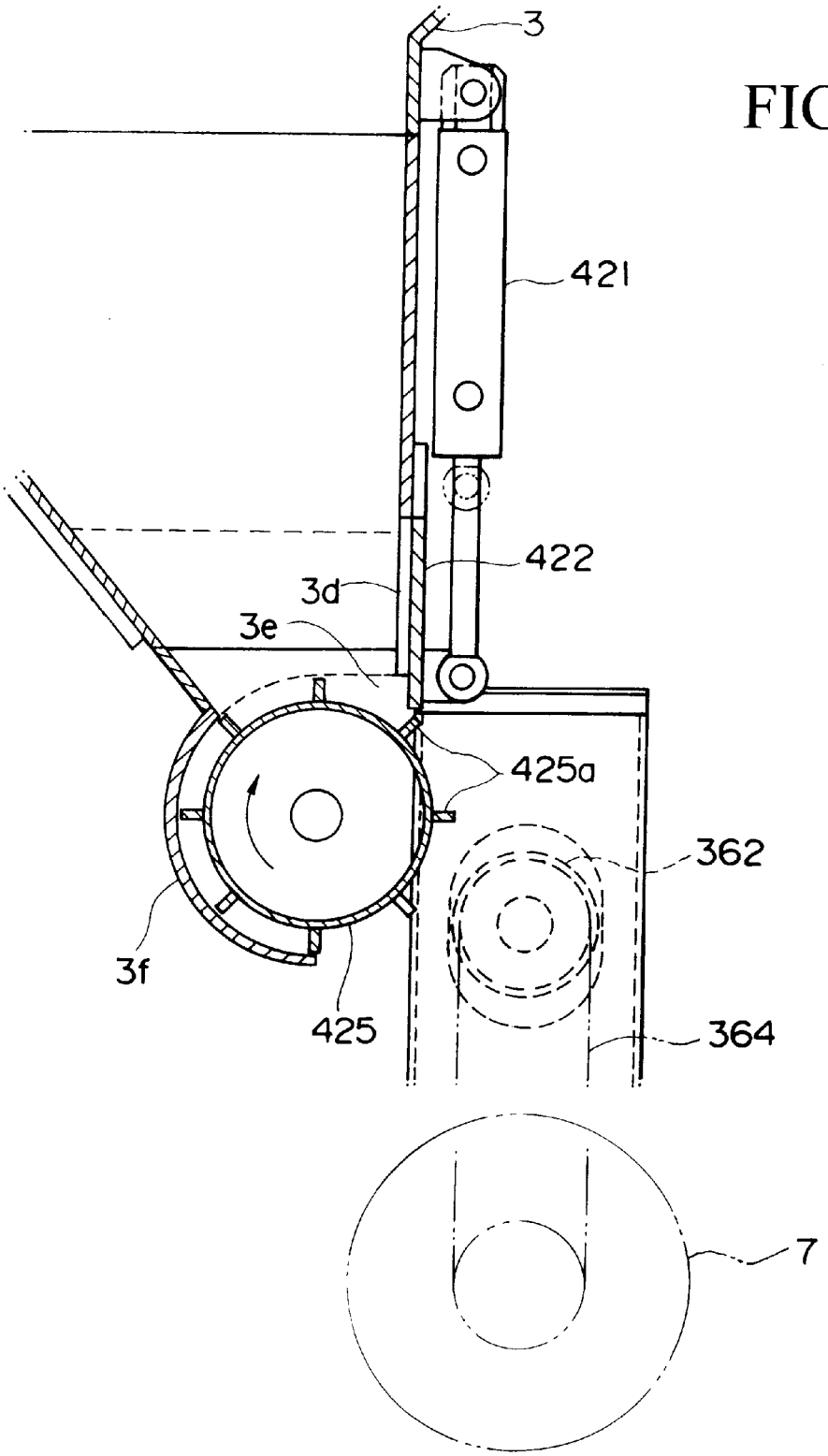
FIG. 25 is a sectional view of the main parts of the hopper shown in FIG. 23.

Another embodiment of the present invention will now be described with reference to FIG. 23 through FIG. 25.

This embodiment particularly relates to a modification of the rear hopper 3 of the paving machine shown in FIG. 1.

In the case of this embodiment, the rear hopper 3 has a pair of left and right rear drop ports 3*d* and bottom drop ports 3*e* for letting the paving materials Hb fall. These drop ports 3*d* and 3*e* are fixed to the self-propelled vehicle 1 above the rear spreading screw 7. Both the rear drop ports 3*d* and the bottom drop ports 3*e* are formed parallel with each other in the widthwise direction of the rear hopper 3 (in the left and right direction in FIG. 24). Moreover, the bottom drop ports 3*e* and the rear drop ports 3*d* are formed in line in the fore and aft direction each other.

Each rear drop port 3*d* is respectively provided with a shutter (opening/closing device) 422 for opening and closing the rear drop port 3*d* by being moved up and down by means of an opening/closing cylinder (actuator) 421. Moreover, each bottom drop port 3*e* is respectively provided with a rotation roll (opening/closing device) 425 which is rotated by a variable speed opening/closing motor 424 to discharge the paving materials from the bottom drop port 3*e*.

The shutter 422 moves up and down along guides 427. The rotation roll 425 is equipped with a number of blades 425*a* (eight blades in the figure) evenly spaced around the outer peripheral face thereof, and rotates in the direction shown by the arrow in FIG. 25, about a shaft 425*b* supported by bearings 428. At a front edge of the bottom drop port 3*e* of the rear hopper 3, an arcuate cover plate 3*f* is disposed, covering the front half of the rotation roll 425, so as to prevents the paving materials Hb from falling from the front part of the bottom drop port 3*e* during rotation of the rotation roll 425.

The front plate 3*a* of the rear hopper 3 is made to be freely pivoted up and down about a hinge 429, to make it possible to lower the loading feeder 16 when the paving machine is deadheaded (see the chain line in FIG. 1). When the paving materials are put into the rear hopper 3 from the loading feeder 16, the front plate 3*a* is raised to a middle position, as shown by the broken line in FIG. 23, by a pair of left and right cylinders 431, so that the amount of the paving materials to be supplied can be as large as possible. The paving materials slip downwardly under gravity when the slide angle is 50 degrees or more. Therefore when the front plate 3*a* is raised to the position shown by the solid line in FIG. 23, so that the slide angle of the front plate 3*a* becomes 50 degree or more, the paving materials in the rear hopper 3 slip down into each of the rear drop ports 3*d* and 3*e*. In addition, opposite edges 3*g* of the front plate 3*a* are bent perpendicularly to the front plate 3*a*.

The operation of the paving machine having the above construction will now be described focusing on the operation of the rear hopper 3.

In the paving materials paving operation, the paving materials Hb in the rear hopper 3 are spread to the side by rotation of the rear spreading screw 7. In this case, there are three methods for supplying the paving materials Hb to the rear spreading screw 7, that is:

(a) to open the rear drop port 3*d* by raising the shutter 422 with the opening/closing cylinder 421;

(b) to rotate the rotation roll 425 with the opening/closing motor 424; or (c) to effect the operation of (a) and (b) simultaneously.

In the case of (a), the paving materials Hb in an amount corresponding to the opening amount of the rear drop port 3*d* fall down from the rear drop port 3*d* onto the rear spreading screw 7. Moreover, since the construction of the opening/closing device of the rear drop port 3*d* is simple, the number of damages are reduced, thus reducing the operating costs. In the case of (b), the blades 425*a* discharge the paving materials Hb from the bottom drop port 3*c* by rotation of the rotation roll 425, allowing the paving materials Hb to fall onto the rear spreading screw 7. In this case, the amount of the paving materials dropping are proportional to the rotation speed of the rotation roll 425, enabling the amount of the paving materials being supplied to be accurately controlled. On the other hand, the method (c) is used when a relatively large amount of paving materials are to be dropped. Moreover, when the paved thickness in the widthwise direction of the road surface is to be changed, the drop amount of the paving materials from the two drop ports 3*d* and 3*e* arranged side by side, are relatively changed.

In the case of any of the above described methods (a), (b) and (c), since the paving materials are supplied by dropping onto the rear spreading screw 7 under gravity, a feeder is not required. Moreover, the motive power required for the operation is only that for opening or closing the shutter and/or for rotating the rotation roll 425. Hence the operating costs are very small.

Furthermore, since a plurality of drop ports 3*d*, 3*e* are formed in the rear hopper 3, and each drop port 3*d*, 3*e* is respectively provided with an opening/closing device, the scope for control of supply of the paving materials are increased, enabling correspondence with various paving conditions. In particular, since a plurality of drop ports 3*d*, 3*e* are provided in line in the widthwise direction of the rear hopper 3, the amount of the paving materials to be supplied along the widthwise direction of the rear hopper 3 can be changed, making it possible to correspond with various paving conditions.

This embodiment may be modified from the example shown in the drawings, for example, as described below.

(1) The number of drop ports is not limited to the number shown in the figure, and may be any number more than 1.

(2) Either one of the shutter 422 or the rotation roll 425 is eliminated.

(3) The rear drop port 3*d* and the bottom drop port 3*e* are disposed so as not to be fore and aft.

(4) The rear drop port 3*d* is provided in front of the bottom drop port 3*e*.

(5) One of the two drop ports which are adjacent to each other linearly in the widthwise direction of the road surface is provided with the shutter 422, and the other is provided with the rotation roll 425.

(6) The paving materials are made to drop from the rear drop port 3*d* by rotation of the rotation roll 425.

With the present example, by closing the drop port 3*d* with the shutter 422, only the paving materials accumulated between the adjacent blades 425*a* can be made to drop by rotation of the rotation roll 425.

Furthermore, it is possible to provide a hinge at the upper end of the rear drop port 3*d* and pivot the shutter 422 about the hinge. It is a matter of course that this embodiment can be applied to a conventional paving machine where only one hopper is provided.

Fourth Embodiment

An other embodiment of the present invention will now be described with reference to FIG. 26 through FIG. 32. This embodiment relates particularly to an improvement of the crawlers 11 and 12 of the paving machine shown in FIG. 1.

Figure 26:
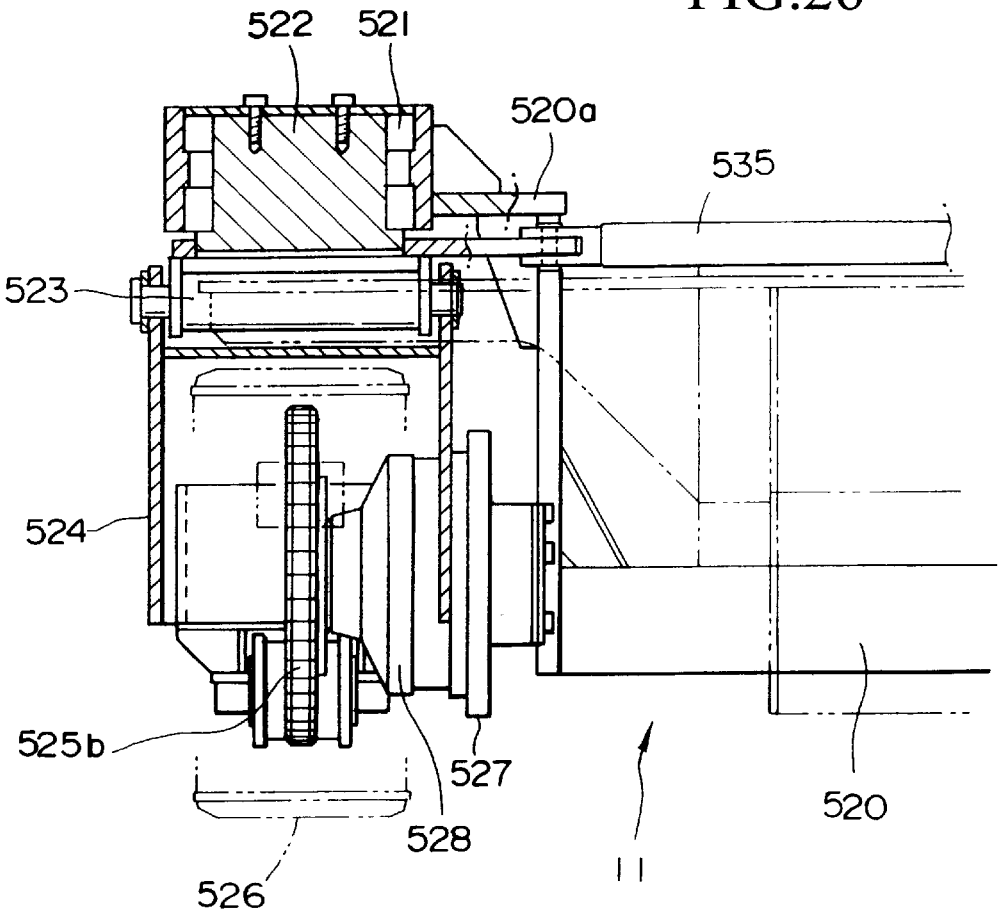
FIG. 26 is a view in the direction of an arrow X in FIG. 29.
Figure 27:
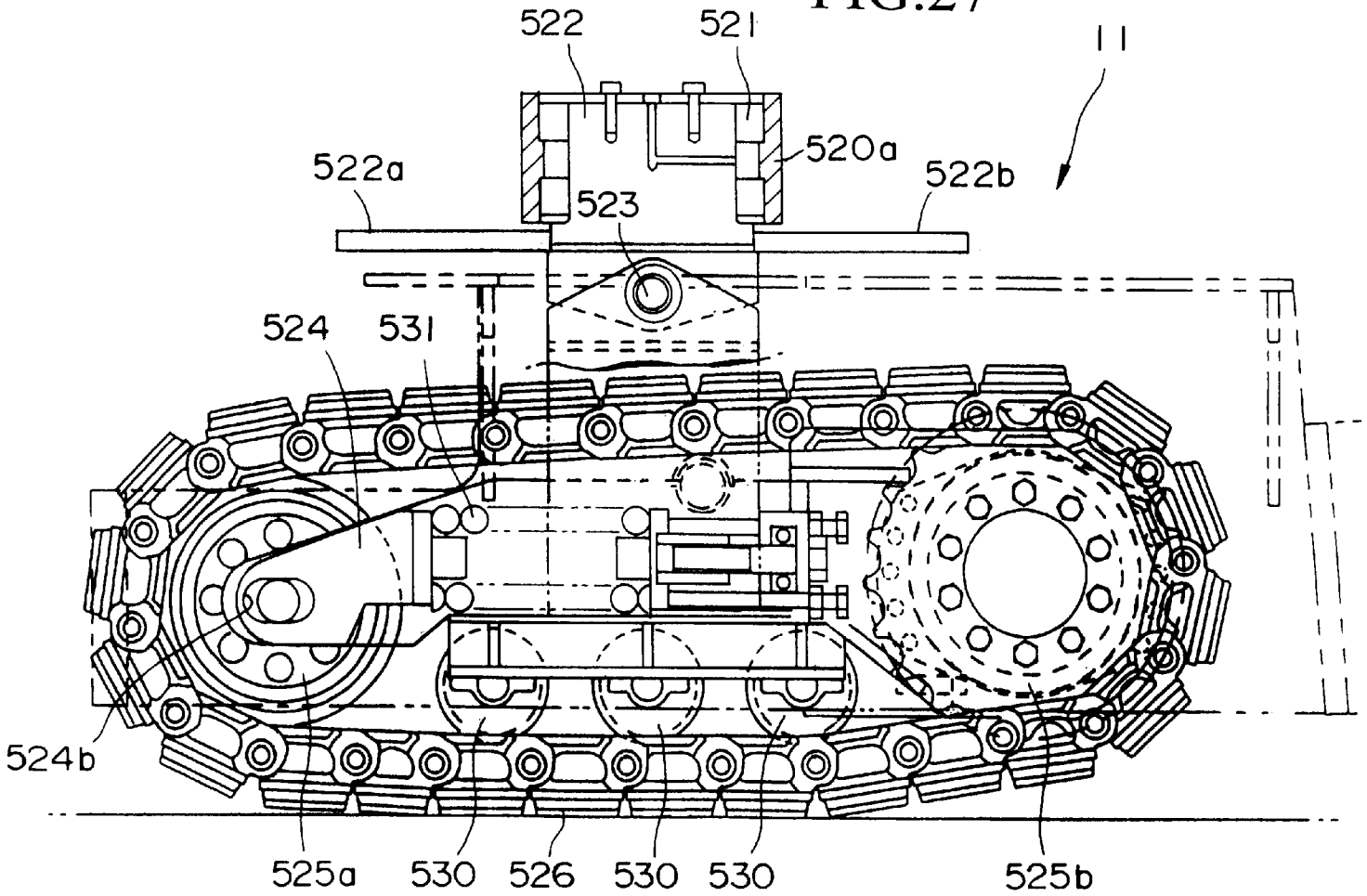
FIG. 27 is a side view of a front crawler.

For example, in the case of the front crawler 11, the tip of a beam 520 extending to the left and right of the vehicle body frame is raised upward as shown in FIG. 26, and a pivot body 522 is supported so as to be pivotal horizontally on the raised portion 520*a*, via a bearing 521. A driving wheel supporting portion 524 is supported on the pivot body 522, so as to be pivotal up and down via a horizontal shaft 523. A pair of driving wheels 525*a*, 525*b* are supported on the driving wheel supporting portion 524 spaced apart in the fore and aft direction as shown in FIG. 27. Moreover, around the driving wheels 525*a* and 525*b* is wrapped an endless crawler body 526. Attached to the driving wheel supporting portion 524 is a bracket 527 on which a hydraulic motor 528 for rotating the rear driving wheel 525*b* is integrally supported.

Figure 28:
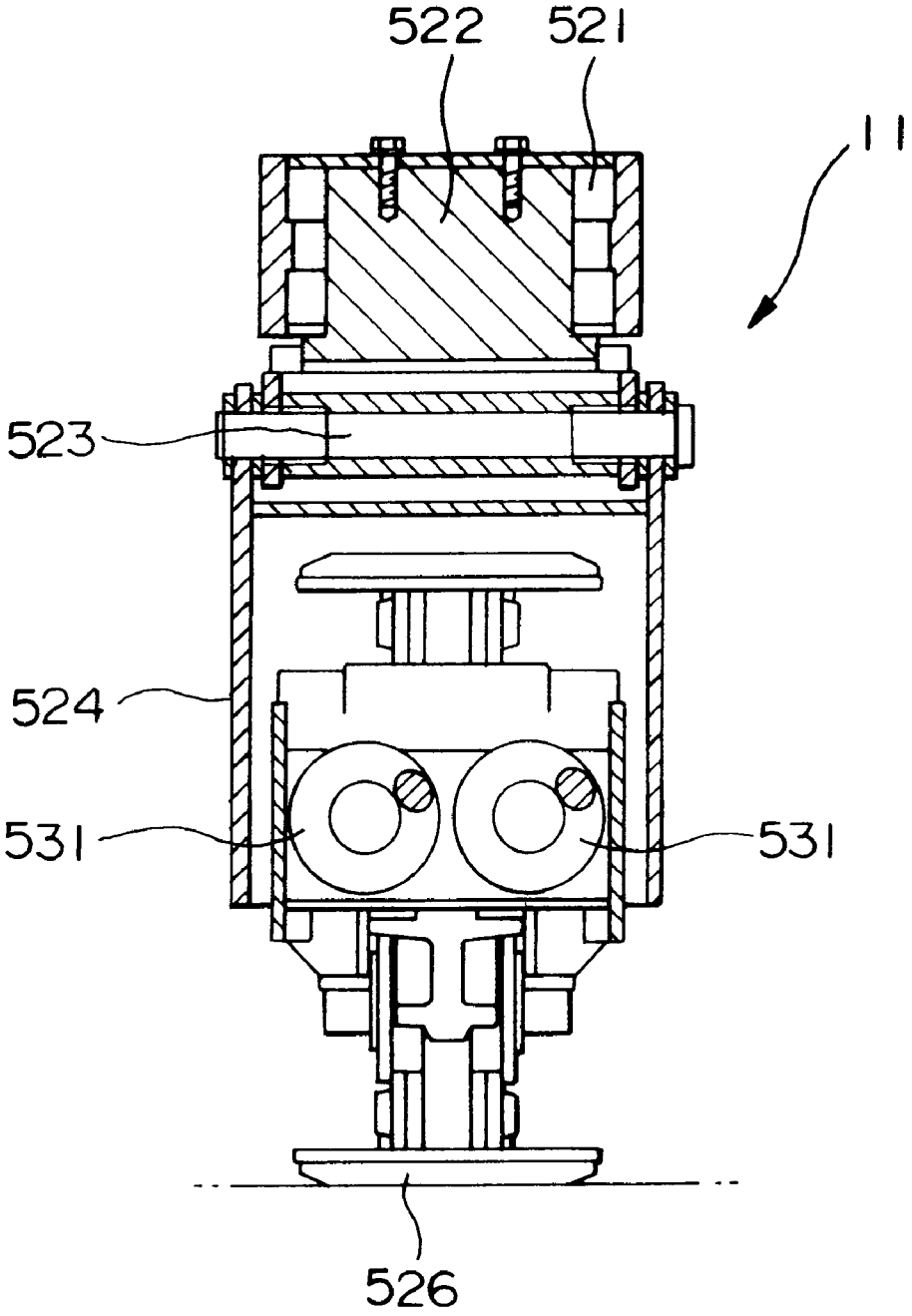
FIG. 28 is a view in the direction of an arrow Y in FIG. 29.
Figure 29:
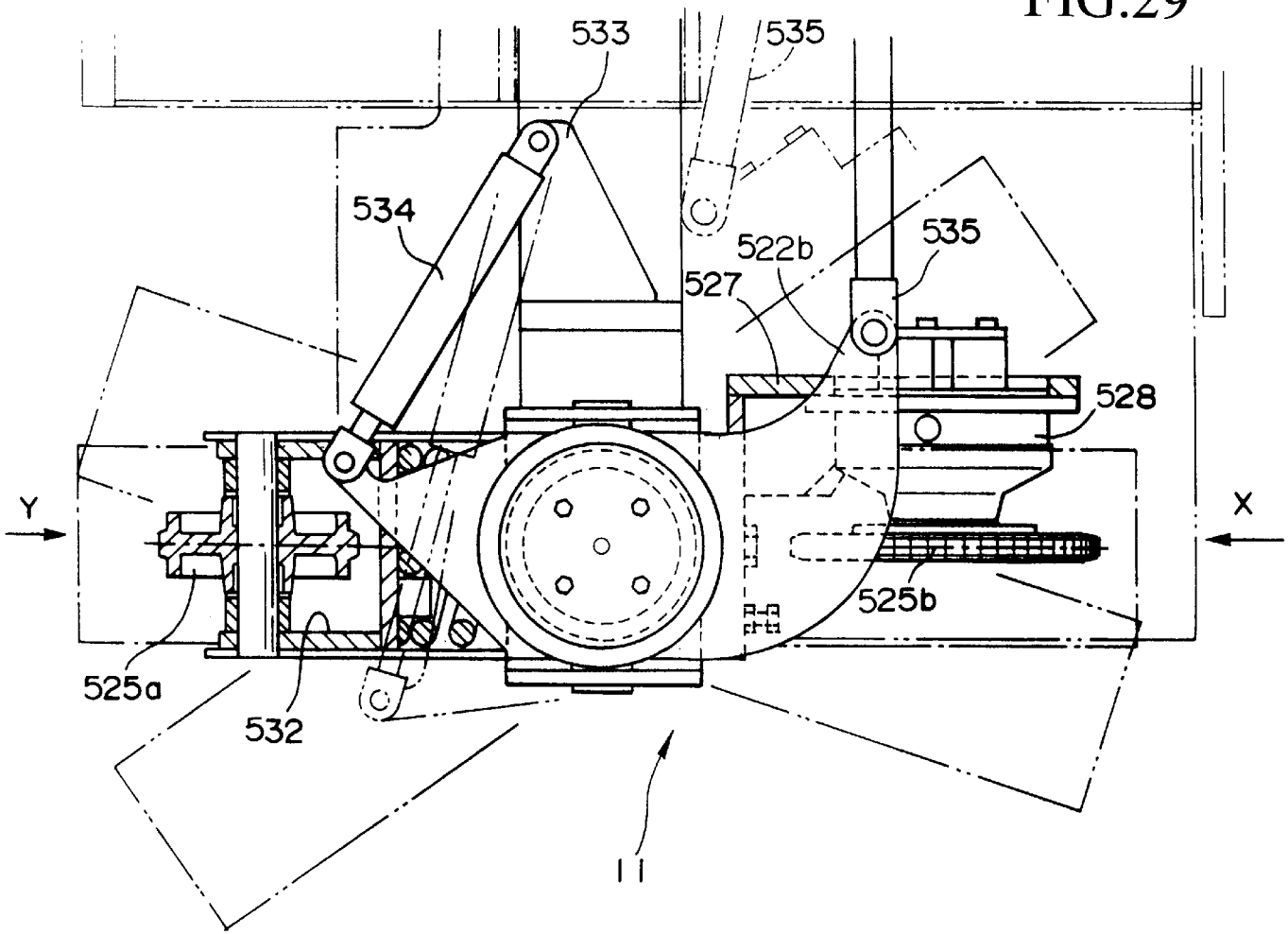
FIG. 29 is a plan view of the front crawler.

A plurality of rolling wheels 530 are supported on the driving wheel supporting portion 524 so as to be located between the front and rear driving wheels 525*a* and 525*b*. These rolling wheels 530 contact against the inside upper faces of the crawler bodies 526. Moreover, two springs 531 are housed side by side as shown in FIGS. 28 and 29, in the driving wheel supporting portion 524. By means of these springs 531, the front driving wheel 525*a* can be moved forward by the amount of an elongate hole 524*b* (see FIG.

27) in the driving wheel supporting portion 524, via a bracket 532 (see FIG. 29) for supporting the driving wheel.

An arm 522*a* is formed on the pivot body 522 so as to protrude forward (see FIG. 27), and a cylinder 534 is attached between the arm 522*a* and a stay 533 formed integrally with the beam 520 (see FIG. 29). By extending or retracting the cylinder 534 using a hydraulic control device (not shown) or the like, the front crawler 11 is turned around the pivot body 522 from side to side.

An arm 522*b* is integrally formed on the arm 522*a*. The left and right front crawlers 11 are connected to each other via a tie rod 535 provided on the arm 522*b*. As a result, the left and right crawlers 11 turn through at an angle with specific relation each other. Since the left and right crawlers 11 are connected by the tie rod 535, the cylinder 534 for turning the front crawlers 11 need only be disposed on one of the crawlers 11. However if the front crawlers 11 are to be turned with a large output, the cylinders 534 may be disposed on both the left and right crawlers 11.

Figure 30:
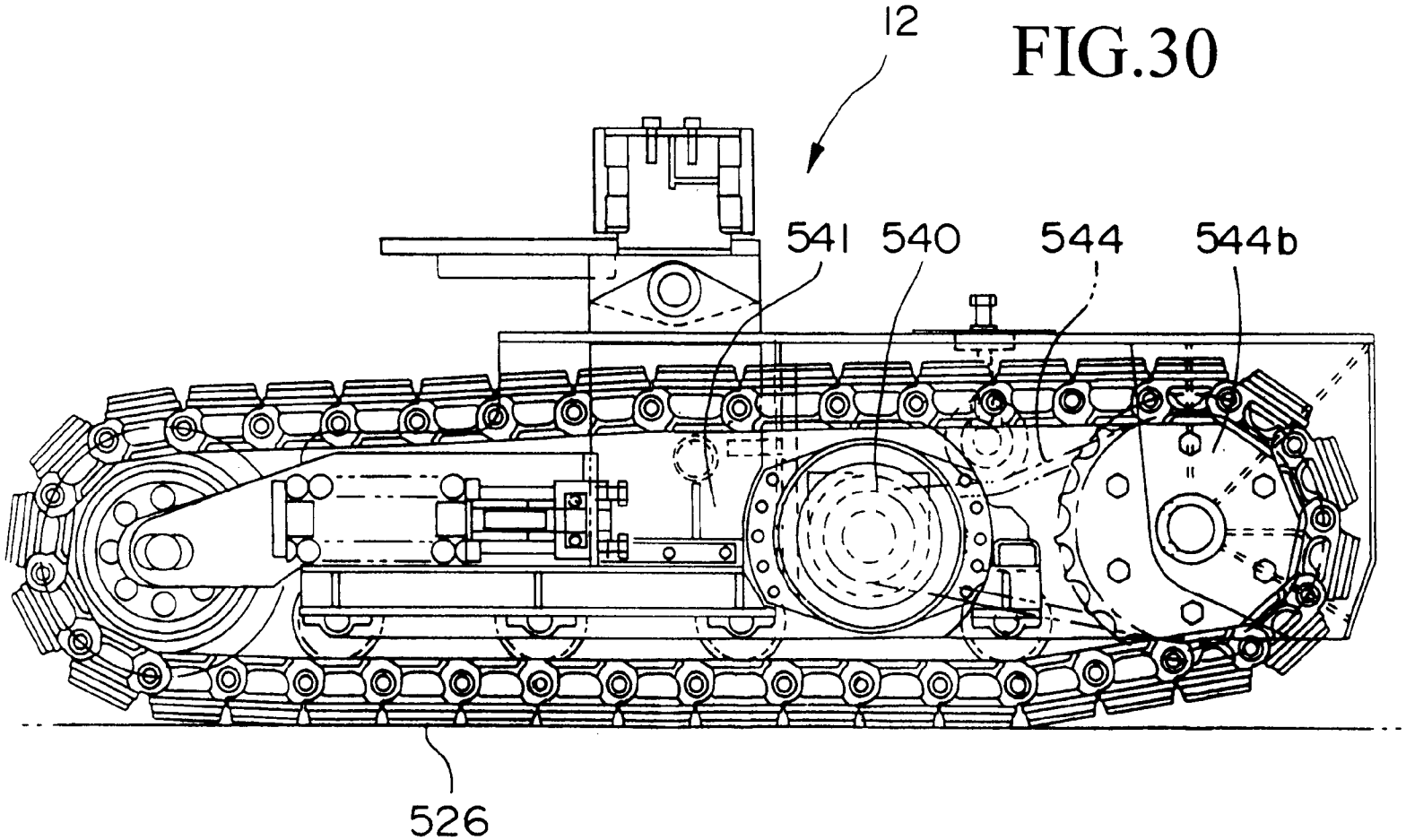
FIG. 30 is a side view of a rear crawler in the embodiment of the present invention.
Figure 31:
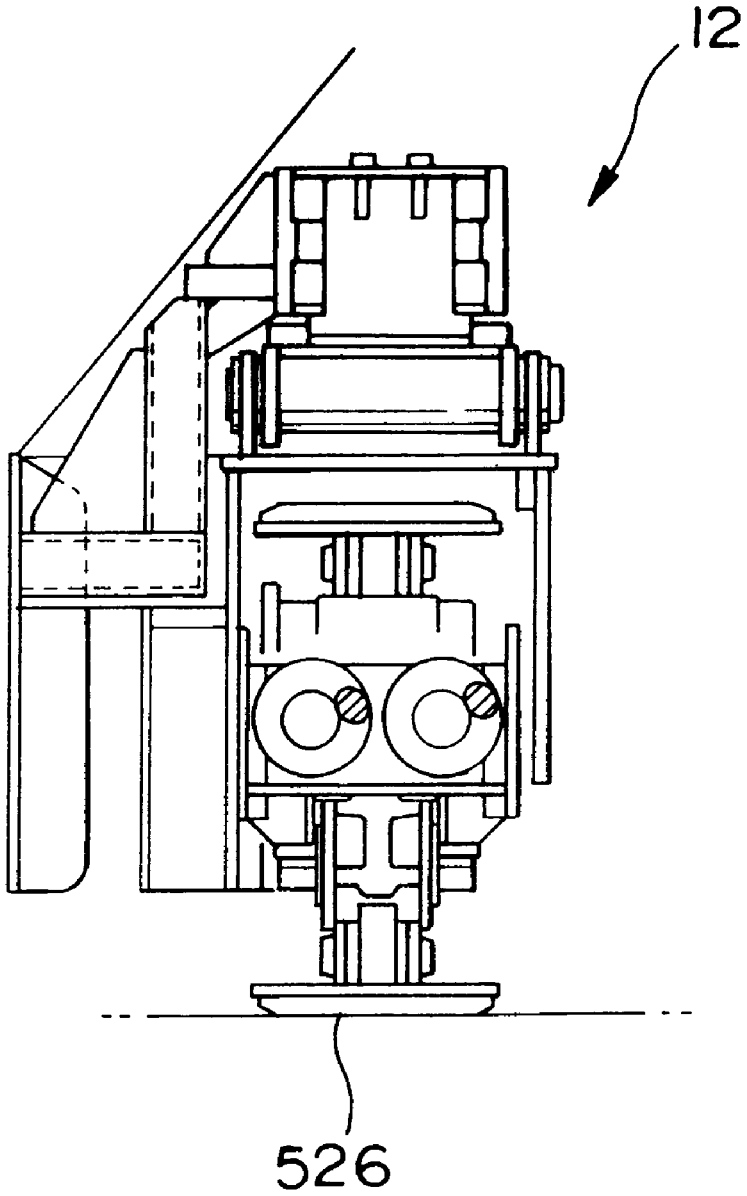
FIG. 31 is a view in the direction of an arrow Z in FIG. 32.
Figure 32:
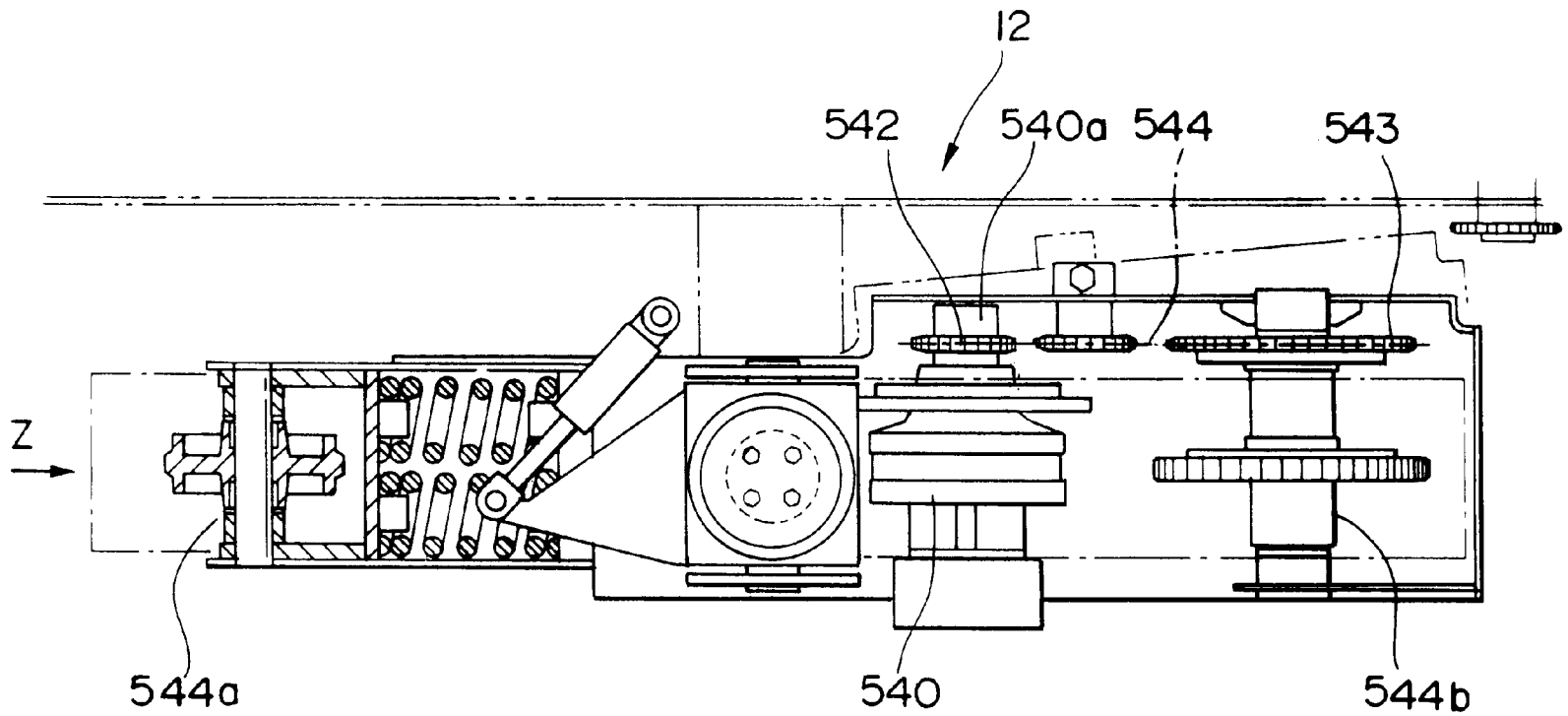
FIG. 32 is a plan view of the rear crawler in the embodiment of the present invention.

The case for the rear crawler 12 is shown in FIG. 30 through FIG. 32. In the case of the rear crawler 12, the structure is basically the same with that of the front crawler 11 described above. The detailed structure however differs in part, as described below.

In the case of the rear crawler 12, a driving hydraulic motor 540 is supported by a driving wheel supporting portion 541 located at a position shifted slightly rearward from the center. The driving power transfer from an output shaft 540*a* of the hydraulic motor 540 to rear driving wheels 544*b* is effected by sprockets 542, 543 and a chain 544 wrapped therearound. The structure that crawler bodies 526 are wrapped between the rear driving wheels 544*b* and the front driving wheels 544*a* is the same as for the front crawler 11. Moreover, the angle allowable for turning the rear crawler 12 is set so as to be smaller than that for the front crawler 11. A tie rod for connecting the left and right rear crawlers 12 is not provided.

The operation of the paving machine having the above described construction will now be described, focusing on the operation of the crawlers 11 and 12.

At the time of a paving operation, or when traveling to a site before or after the paving operation, when the self-propelled vehicle 1 turns to left or right, the cylinder 534 is extended or retracted, and as shown by the chain line in FIG. 29, the front crawler 11 is turned to the left or to the right together with the pivot body 522. When the hydraulic motor 528 provided in the left and right front crawlers 11 is rotated, the crawler bodies 526 are moved around the driving wheels 525*a* and 525*b*, with the front crawlers 11 moving in the traveling direction. In this case, control is such that the hydraulic motor located on the outer wheel side rotates faster than the hydraulic motor located on the inner wheel side. With this embodiment, since the left and right front crawlers 11 can be aligned with the traveling direction, smooth turning is possible.

Furthermore, since the left and right front crawlers 11 are connected by the tie rod 535, then when either one of the left and right front crawlers 11 is turned, the other front crawler 11 turns at the angle with specific relation in the same direction. Thus, the left and right front crawlers 11 can be turned in a desired direction always at the specific angle, and hence turning is faster. Moreover, since the left and right front crawlers 11 are connected with a very simple construction, the apparatus can be manufactured at a lower price.

Furthermore, when the self-propelled vehicle 1 is turned, the rear crawlers 12 can also be turned. Hence, if the rear crawlers 12 are turned in the opposite direction to the front crawlers 11, compact turning with a small turning radius becomes possible. Moreover, if the front and rear crawlers 11, 12 are turned in the same direction, it is possible to move the self-propelled vehicle sideways.

Furthermore, since the left and right crawlers 11, 12 are separated fore and aft, the length of each crawler becomes short. Since the resistance power to the crawler at the time of turning is proportional to the length of the crawler, then the traction force required for the crawler is reduced by the amount of shortened length of the crawler. As a result, the traction force required for the crawler on the outer wheel side at the time of turning also becomes small. Hence, the hydraulic motors 528, 540, the cylinders 534 and the like may be of a low output, resulting in a small and low cost construction for the paving machine.

In the above described embodiment, the crawlers 11 and 12 of the present invention have been described, by way of examples, for when they are applied to a paving machine which lays and paves different paving materials on top of each other at the same time. However, the crawlers 11 and 12 of the present invention can be applied to all types of paving machines provided they are equipped with a crawler type propulsion apparatus. Moreover, when the left and right crawlers are separated, this is not limited to being separated into two at front and rear, it being also possible to separate them into three, that is, front, rear and middle crawlers.

Fifth Embodiment

An other embodiment of the present invention will now be described with reference to FIG. 33 through FIG. 37. This embodiment relates particularly to an improvement to the hoppers 2 and 3 to make the paving machine shown in FIG. 1 smaller.

With this embodiment, the front hopper 2 and the rear hopper 3 are shifted vertically so that the rear hopper 3 is located above the front hopper 2, and are also shifted fore and aft. Specifically, the front hopper 2 is shifted rearward, and the rear hopper 3 is shifted forward. Moreover, when seen from the top, the front hopper 2 and the rear hopper 3 are so arranged that at least a part of them, in this embodiment, the rear part of the front hopper 2 and the front part of the rear hopper 3 overlap each other (see FIG. 33 and FIG. 35). As a result, with this embodiment, while the capacity of each hopper 2 and 3 is held, the vehicle can be made compact.

The front hopper 2 is formed from an inclined front plate 2*a*, left and right front side plates 2*b*, left and right rear side plates 2*c* having upright plates 2*cc*, and a rear plate 2*d*. Moreover, the rear hopper 3 is formed from a bottom plate 3*h*, left and right side plates 3*i*, and a rear wall 3*b*.

Furthermore, a movable bottom 63 constituting the bottom plate 3*h* of the rear hopper 3 is disposed so as to be pivotal up and down about a pivot shaft 64. The movable bottom plate 63 is pivoted up toward paving materials discharge port 67 of the rear hopper 3, as shown by the chain line in FIG. 33, by cylinders 66 interposed between a frame 65 and the movable bottom 63.

Figure 34:
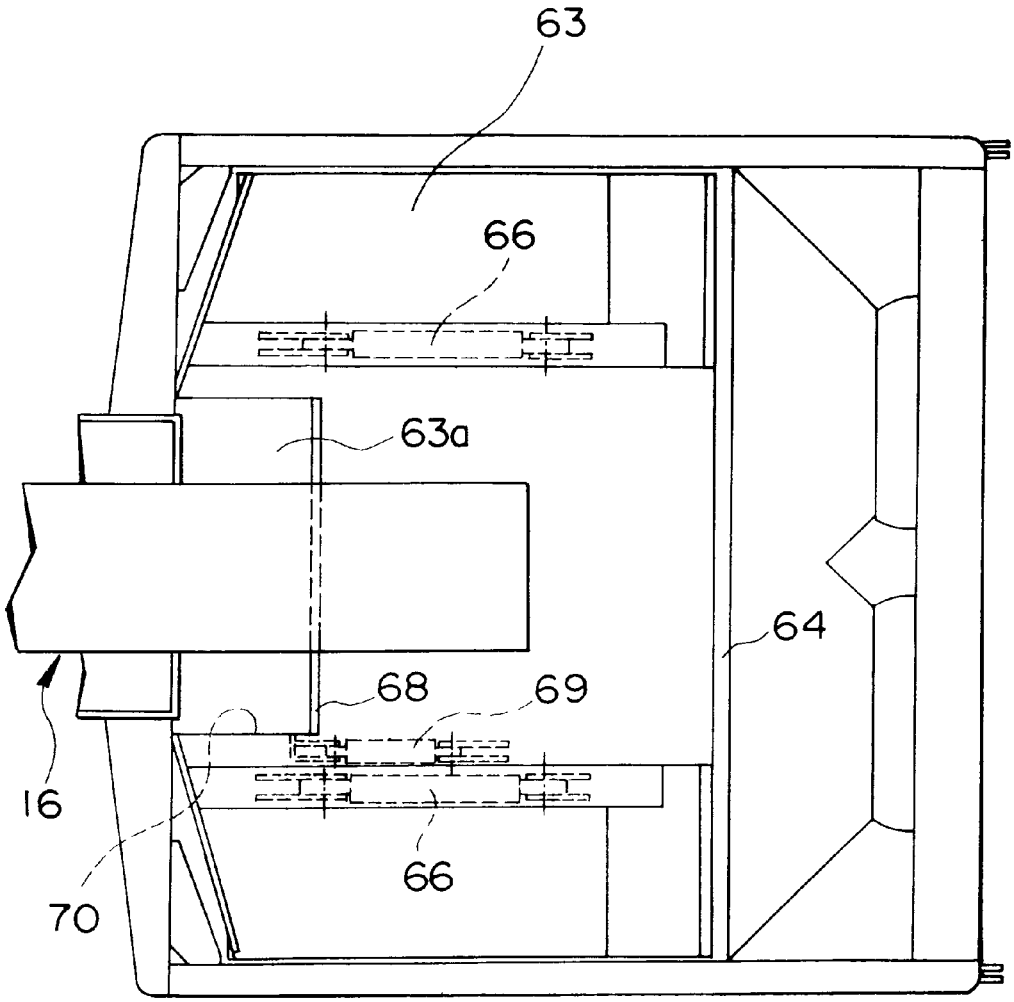
FIG. 34 is a plan view of the rear hopper in the embodiment of the present invention.

A front part 63*a* of the movable bottom 63 can be pivoted either up or down about a pivot shaft 68 supported on the movable bottom 63. The front part 63*a* is pivoted by a cylinder 69 interposed between the front part 63*a* and the other part of the movable bottom portion 63, and as shown in FIG. 34, the width of the front part 63*a* is sufficiently wider than the width of the loading feeder 16. Moreover, the relative position of the front hopper 2 and the rear hopper 3 is so set that when the front part 63*a* is open, the front hopper 2 is located beneath an opening 70 of the rear hopper 3.

The operation of the paving machine having the above construction will now be described, focusing on the operation of the front hopper 2 and the rear hopper 3.

Figure 33:
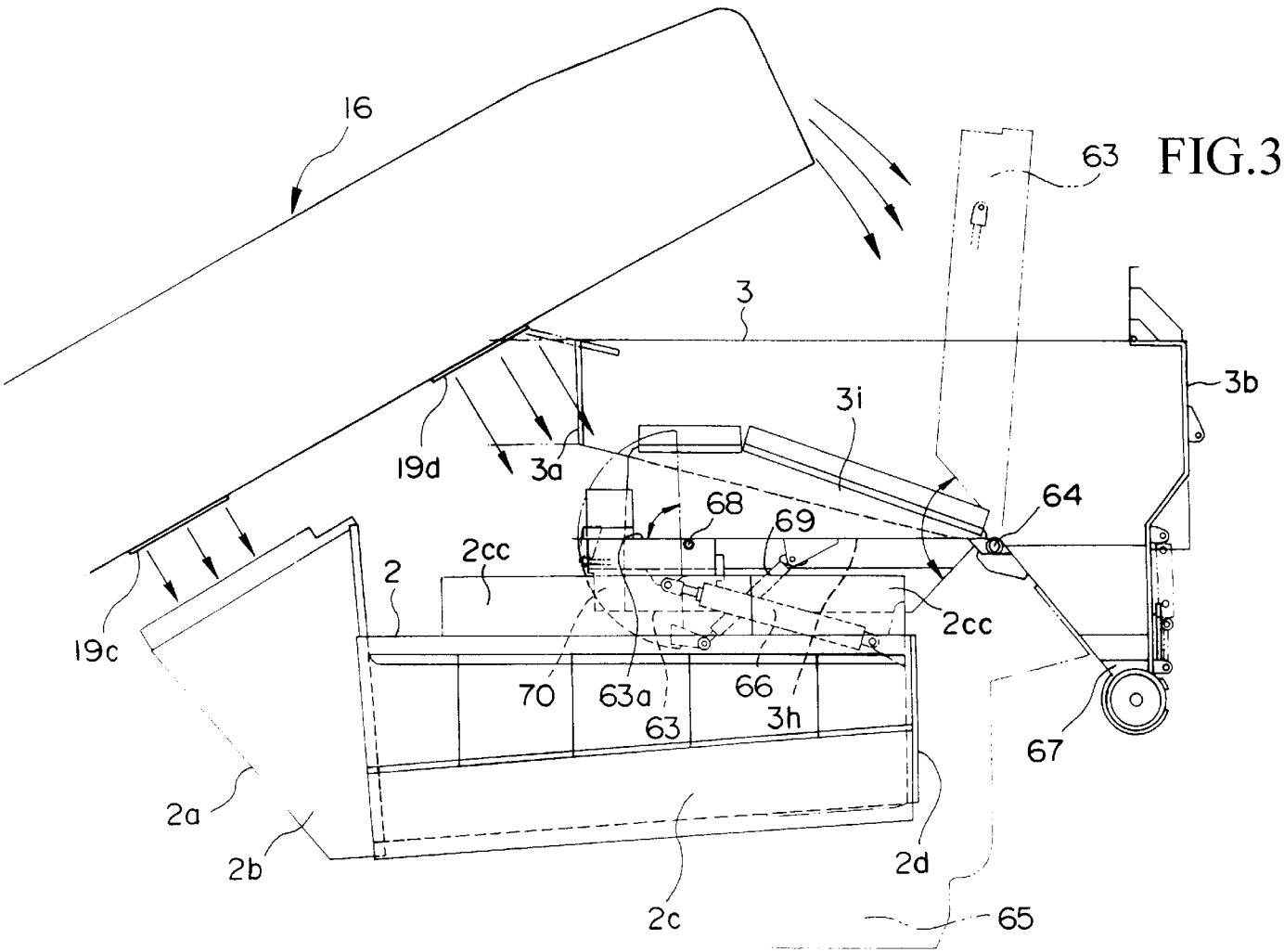
FIG. 33 is a side view showing the relationship between the front hopper and the rear hopper in the embodiment of the present invention.

When the paving materials Ha are supplied from the discharge port 19*d* at the upper end of the loading feeder 16 to the front hopper 2, the cylinder 69 is extended in advance, and as shown by the chain line in FIG. 33, the front part 63*a* of the movable bottom 63 is opened. As a result, the paving materials Ha are supplied to the front hopper 2 through the opening 70 formed in the front part 63*a*.

On the other hand, if it is possible to load the paving materials Ha only from a portion (a front part) of the front hopper 2 which extends forward from under the rear hopper 3, then the paving materials Ha are loaded more toward the front part of the front hopper 2. Hence sufficient discharge of the paving materials may be difficult. However if it is possible to supply the paving materials Ha to the front hopper 2 through the opening 70 formed in the rear hopper 3, a pile of the supplied paving materials Ha are also formed in the central part of the front hopper 2, and hence the paving materials Ha can be sufficiently discharged.

Furthermore, when for example paving materials Hb having high durability are supplied to the rear hopper 3, the discharge ports 19*c* and 19*d* are closed with the lids 35 (see FIG. 3), and the paving materials Hb in the receiving hopper 17 and the supplementary hopper 49 are dropped from the discharge end 19*b* into the rear hopper 3.

At this time, by extending the cylinder 69 to close the front part 63*a* of the movable bottom 63, the paving materials Hb can be supplied to the rear hopper 3.

When the amount of the paving materials in the rear hopper 3 is reduced, the cylinder 66 is extended and the movable bottom 63 is pivoted upward about the pivot 64. As a result, the movable bottom 63 inclines to relatively lower the paving materials discharge port 67 side so that the paving materials which tend to remain on the movable bottom 63 can be smoothly discharged to the last bit. Therefore, according to this embodiment, while the capacity of the rear hopper 3 is held, the paving materials Hb can be promptly discharged.

With this embodiment, the case for where different paving materials are simultaneously laid and paved so that they form two layers on top of each other has been described by way of examples. However the paving machine having a plurality of hoppers 2, 3 can be applied to the case where only one kind of paving materials are paved. In this case, only one spreading screw 5 or 7 and one screed 8 or 9 is used. For example, assuming a construction where the paving materials discharged from the front hopper 2 are supplied directly to the rear spreading screw 7 by the bar feeder 4, the front spreading screw 5 and the front screed 8 are not required.

Figure 35:
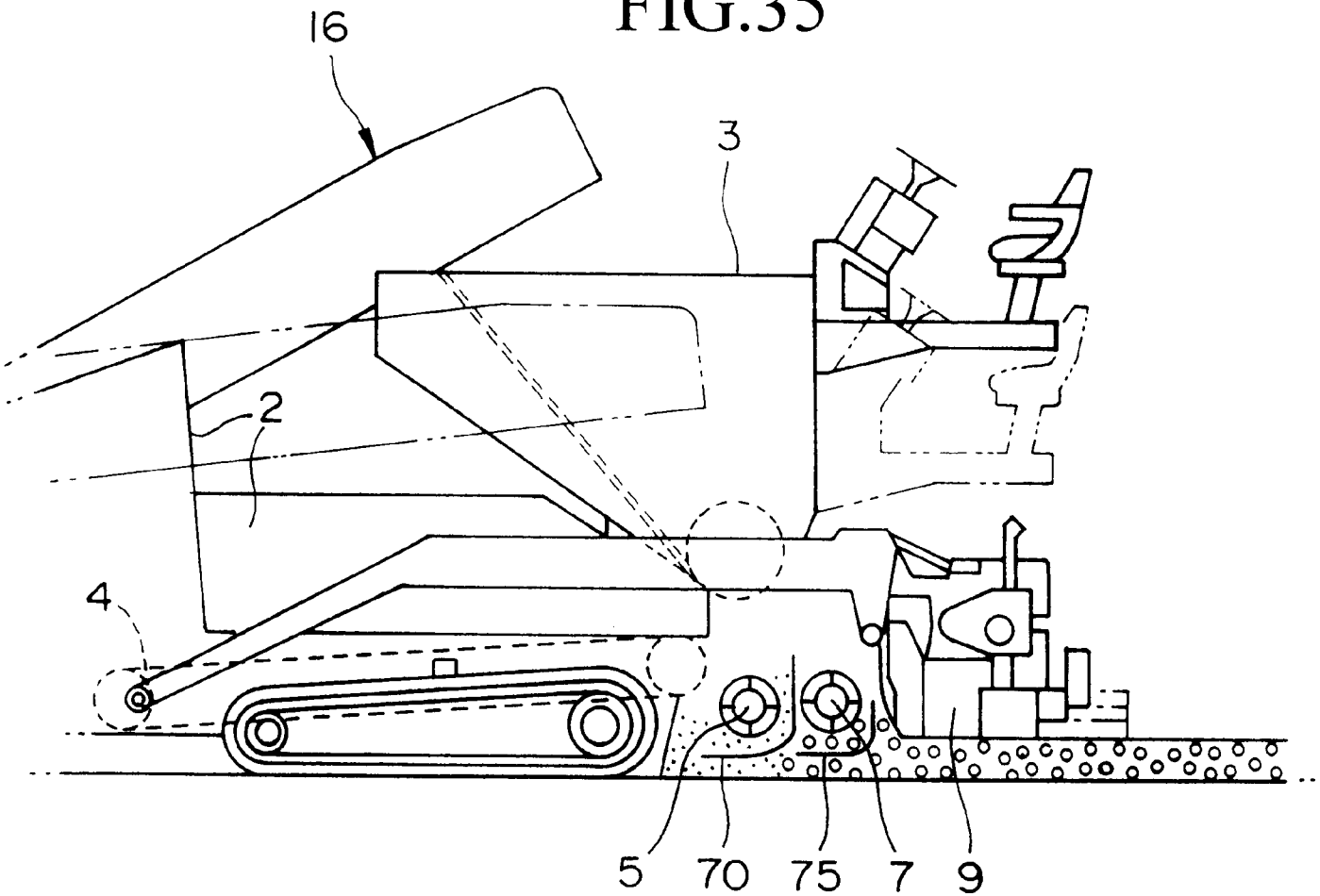
FIG. 35 is a partial side view of the paving machine in the embodiment of the present invention.
Figure 36:
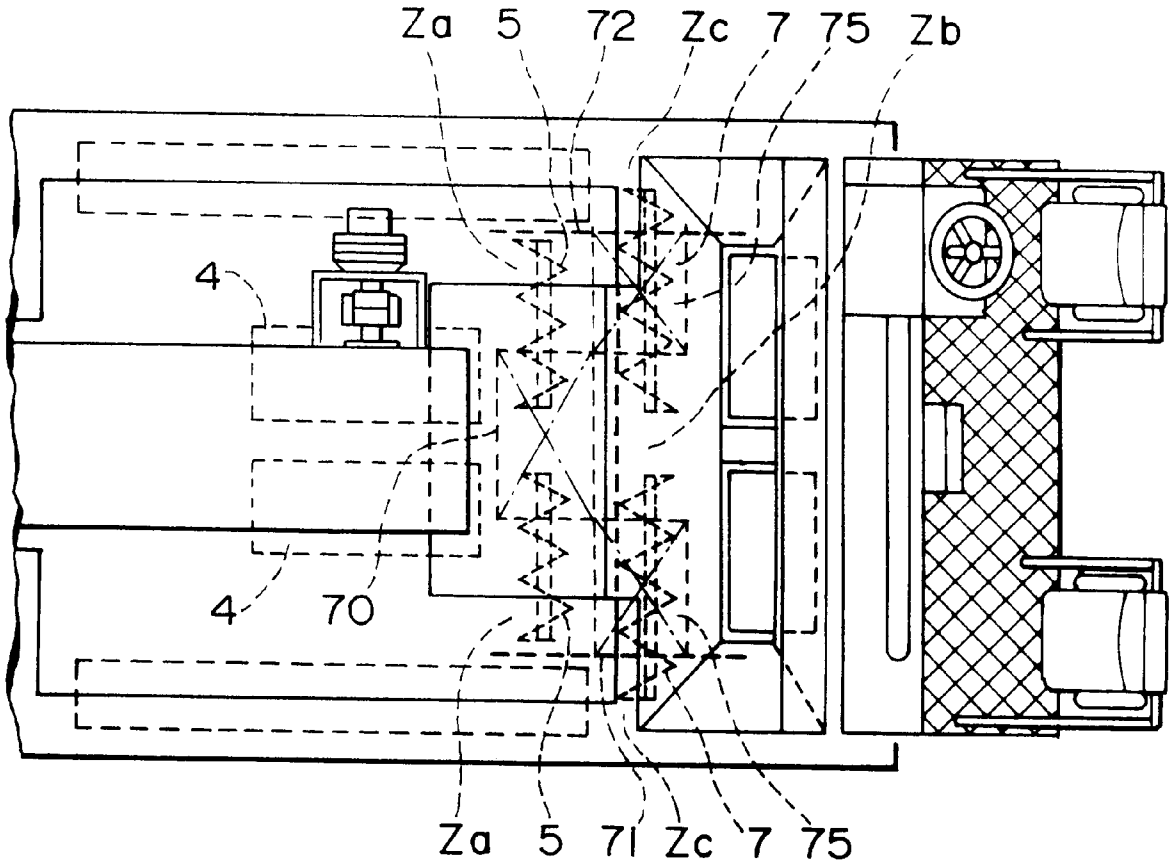
FIG. 36 is a partial plan view of the paving machine shown in FIG. 35.
Figure 37:
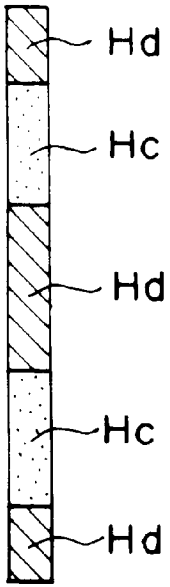
FIG. 37 is a sectional view of a road laid and paved by the paving machine shown in FIG. 35.
Figure 38:
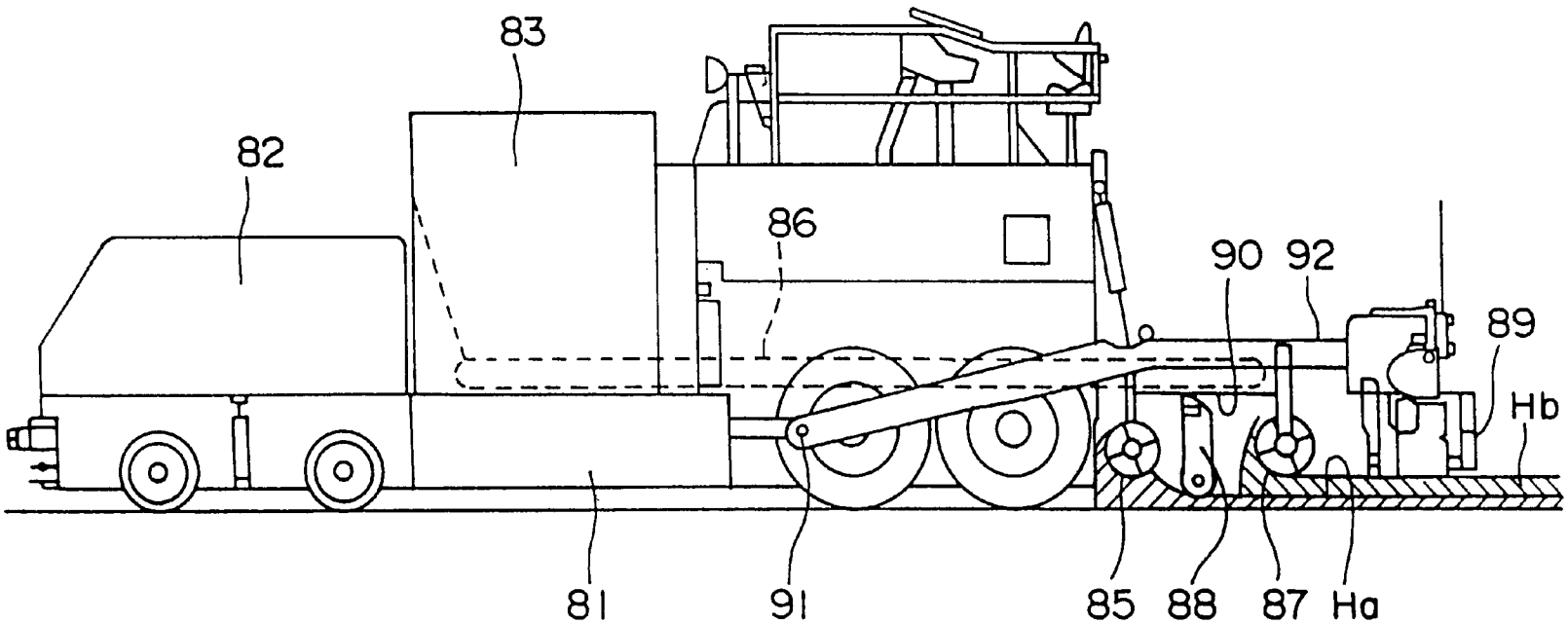
FIG.38 (Prior Art)
FIG. 38 is a side view of a conventional paving machine.

Different paving materials can also be paved in the widthwise direction of the road surface as shown in FIG. 37, by using a paving machine comprising a plurality of hoppers 2, 3. In this case, as shown in FIG. 35 and FIG. 36, paving materials Hc discharged from the front hopper 3 by the bar feeder 4 to the center in the widthwise direction of the self-propelled vehicle 1, are spread sideways by the front spreading screws 5, and supplied to a band Za surrounded by the outside of a central flat covering plate 70 and left and right parting plates 71 and 72. On the other hand, paving materials Hd supplied from the rear hopper 3 are spread to the center and to the left and right sides by the rear spreading screws 7, and supplied to a central band Zb and to a outside band Zc of a flat covering plate 75. When these paving materials Hc and Hd are laid and paved by the screed 9 as shown in FIG. 37, it is possible to lay and pave a spot of the road where a hollow is likely to be formed, with the paving materials Hc having excellent durability, and to pave other portions with the paving materials Hd which does not have excellent durability, but which are relatively cheap.

With this embodiment, an example has been given for the case having two hoppers, that is, the front hopper 2 and the rear hopper 3. However three or more hoppers are also possible. Moreover, the loading feeder 16 may be provided one each for each hopper, rather than one for a paving machine.

For the respective cylinders 28, 34, 45, 51, 56, 66, 69, 326, 336, 421, 431 and 534, hydraulic cylinders are normally used. However it is also possible to use air cylinders. Moreover, for the motors 27, 140, 361, 362, 366 and 424, hydraulic motors or electric motors are used.

What is claimed is:

1. A paving materials loading apparatus comprising:

a paving materials loading feeder so disposed that a lower end of a loading frame thereof is connected to a receiving hopper, a discharge port formed in a middle part of said loading frame between the lower end and a discharge end, and a lid provided on the discharge port so as to be openable and closable.

2. A paving materials loading apparatus according to claim 1, wherein said loading feeder can be raised and lowered.

3. A paving materials loading apparatus according to claim 1, wherein said receiving hopper is provided with wheels for supporting the load of said receiving hopper.

4. A paving materials loading apparatus according to claim 1, wherein said receiving hopper is connected to the loading feeder so as to be pivotal up and down.

5. A paving materials loading apparatus according to claim 1, wherein there is provided supplementary hoppers on the left and right sides of said receiving hopper so as to be foldable over said receiving hopper.

6. A paving materials loading apparatus according to claim 1, wherein said loading feeder comprises an endless chain with flights attached thereto, tensioned between rotation shafts rotatably disposed respectively at the lower end and the discharge end of said loading frame.

7. A paving materials loading apparatus comprising:

a paving materials loading feeder so disposed that a lower end of a loading frame thereof is connected to a receiving hopper, a discharge port formed in a middle part of said loading frame between the lower end and a discharge end, a lid provided on the discharge port so as to be openable and closable, wherein said loading feeder can be raised and lowered, and said receiving hopper is provided with wheels for supporting the load of said receiving hopper, said loading feeder can be freely moved fore and aft and can be freely tilted from side to side, said loading feeder is provided with a stop member for stopping the rearward movement of said loading feeder, and said receiving hopper is provided with a pushing member for pushing a dump truck or the like which replenishes the paving materials into said receiving hopper.

8. A paving materials loading comprising:

a paving materials loading feeder disposed so that a lower end of a loading thereof is connected to a receiving hopper;

at least two discharge ports formed in a middle part of the loading frame between the lower end and a discharge end; and a lid provided on each of the discharge ports, wherein the lid is openable and closeable.

9. A paving machine comprising:

a front hopper and a rear hopper, on a self-propelled vehicle, and a paving materials loading apparatus mounted on said self-propelled vehicle, the paving materials loading apparatus including:

a paving materials loading feeder so disposed that a lower end of a loading frame thereof is connected to a receiving hopper, a discharge port formed in a middle part of said loading frame between the lower end and a discharge end, and a lid provided on the discharge port so as to be openable and closable, wherein the discharge port of said loading feeder is located above said front hopper and the discharge end of said loading feeder is located above said rear hopper.

10. A paving machine according to claim 9, wherein said loading feeder has two rotation shafts disposed in parallel and an endless belt passing around said two rotation shafts, and said paving machine has a screw provided on an input side of said loading feeder, which feeds paving materials to the input side of a loading feeder side, and a rotation shaft for supporting said screw and a rotation shaft on the input side of said loading feeder are disposed independent of each other, and a driving source for said screw and a driving source for said loading feeder are independently provided.

11. A paving machine according to claim 10, wherein the rotation shaft of said screw and the rotation shaft on the input side of said loading feeder are connected rotatably relative to each other via a bearing.

12. A paving machine according to claim 10, wherein said screw is disposed on the left and right sides of the rotation shaft on the input side of said loading feeder, and separate drive sources are provided for the left and right screws.

13. A paving machine according to claim 9, further comprising a driving apparatus provided with:

a vertical rail arranged in an upright condition on the self-propelled vehicle, a floor connected to the vertical rail so as to be freely movable up and down along the vertical rail, a driving seat and driving equipment disposed on the floor, and an elevating apparatus disposed on said self-propelled vehicle for moving said floor up and down.

14. A paving machine according to claim 13, wherein said elevating apparatus has, an elevating cylinder, a sprocket which is moved up and down by the elevating cylinder, and an elongate member wrapped around the sprocket, with one end thereof fixed to a member on a self-propelled vehicle side and an other end thereof secured to a member on a floor side.

15. A paving machine according to claim 13, wherein said driving seat is disposed on said floor so as to be movable from side to side.

16. A paving machine according to claim 15, wherein a steering wheel for driving equipment is disposed on said floor so as to be movable from side to side.

17. A paving machine according to claim 13, wherein a front spreading screw for spreading the paving materials fed from said front hopper sideways, a real spreading screw for spreading the paving materials fed from said rear hopper to a side, a front screed for laying and paving the paving materials spread by said front spreading screw, and a rear screed for laying and paving the paving materials spread by said rear spreading screw are mounted on said self-propelled vehicle, and a driving apparatus is disposed rearward of said rear hopper.

18. A paving machine according to claim 17, wherein said vertical rail is attached to a lift frame on a back wall of said rear hopper.

19. A paving machine according to claim 9, wherein a front spreading screw for spreading the paving materials fed from said front hopper sideways, a rear spreading screw for spreading the paving materials fed from said rear hopper sideways, a front screed for laying and paving the paving materials spread by said front spreading screw, and a rear screed for laying and paving the paving materials spread by said rear spreading screw are mounted on said self-propelled vehicle, and said front screed and said rear screed are respectively suspended apart in the fore and aft direction and so as to be movable relatively in the vertical direction, on a pair of left and right leveling arms supported on said self-propelled vehicle by a pivot shaft so as to be pivotal up and down.

20. A paving machine according to claim 19, wherein at least one of said front screed and said rear screed is extensible and retractable sideways.

21. A paving machine according to claim 19, wherein said rear hopper is disposed so that a paving materials drop port is located above said rear spreading screw.

22. A paving machine according to claim 9, wherein a rear spreading screw for spreading the paving materials fed from said rear hopper sideways, and a screed for laying and paving the paving materials spread by said rear spreading screw, are mounted on a self-propelled vehicle, and said rear hopper has a drop port which can be opened and closed by opening/closing means, and said drop port is located above said rear spreading screw.

23. A paving machine according to claim 22, wherein said opening/closing means is a shutter which is moved by an actuator for opening and closing the drop port.

24. A paving machine according to claim 22, wherein said opening/closing means is a rotation roll which is rotated by a motor to let the paving materials fall from said drop port.

25. A paving machine according to claim 22, wherein opening/closing means comprising a shutter which is moved by an actuator for opening and closing the drop port, and a rotation roll which is rotated by a motor to let the paving materials fall from said drop port are provided at the same drop port.

26. A paving machine according to claim 9, further comprising:

a rear spreading screw for spreading the paving materials fed from said rear hopper sideways, and a screed for laying and paving the paving materials spread by said rear spreading screw, are mounted on a self-propelled vehicle, and said rear hopper has a plurality of drop ports which can be respectively opened and closed by opening/closing means, and said drop ports are located above said rear spreading screw.

27. A paving machine according to claim 26, wherein said plurality of drop ports are formed substantially linearly in the widthwise direction of said rear hopper.

28. A paving machine according to claim 9, wherein propulsion crawlers formed by an endless crawler body wrapped around a pair of driving wheels positioned in spaced apart relation in the fore and aft directions are provided on left and right lower portions of the vehicle body of said selfpropelled vehicle, and said left and right crawlers are separated into front crawlers and rear crawlers.

29. A paving machine according to claim 28, wherein said front crawlers can be turned in a horizontal direction.

30. A paving machine according to claim 28, wherein said front crawlers on the left and right sides are connected by a tie rod and turned through the same angle.

31. A paving machine according to claim 28, wherein said rear crawlers can be turned in a horizontal direction.

32. A paving machine according to claim 9, wherein said front hopper and said rear hopper are provided shifted vertically so that at least a part of the hoppers overlap when seen from above.

33. A paving machine according to claim 32, wherein an upper hopper of said hoppers is provided shifted rearward, and a lower hopper is provided shifted forward, a front part of a bottom face of said upper hopper can be opened and closed, and when said front part is in the open condition, said lower hopper is positioned below an opening of said front part.

34. A paving machine according to claim 32, wherein a bottom face of the upper hopper of said hoppers is able to be pivoted so as to be inclined towards a paving materials discharge port of the upper hopper.

35. A paving machine according to claim 9, wherein the total loading capacity of said front hopper and said rear hopper are larger than at least the amount of paving materials that are fed by a dump truck to the hopper at one time.

36. A paving machine according to claim 9, wherein engines are positioned on the left and right sides of said loading feeder.

37. A paving machine comprising:

a front hopper and a rear hopper, on a self-propelled vehicle, and a paving materials loading apparatus mounted on said self-propelled vehicle, the paving materials loading apparatus including:

a paving materials loading feeder so disposed that a lower end of a loading frame thereof is connected to a receiving hopper, a discharge port formed in a middle part of said loading frame between the lower end and a discharge end, and a lid provided on the discharge port so as to be openable and closable, wherein said loading feeder can be raised and lowered, and wherein the discharge port of said loading feeder is located above said front hopper and the discharge end of said loading feeder is located above said rear hopper.

38. A paving machine comprising:

a front hopper and a rear hopper, on a self-propelled vehicle, and a paving materials loading apparatus mounted on said self-propelled vehicle, the paving materials loading apparatus including:

a paving materials loading feeder so disposed that a lower end of a loading frame thereof is connected to a receiving hopper, a discharge port formed in a middle part of said loading frame between the lower end and a discharge end, and a lid provided on the discharge port so as to be openable and closable, wherein said receiving hopper is provided with wheels for supporting the load of said receiving hopper, and wherein the discharge port of said loading feeder is located above said front hopper and the discharge end of said loading feeder is located above said rear hopper.

39. A paving machine comprising:

a front hopper and a rear hopper, on a self-propelled vehicle, and a paving materials loading apparatus mounted on said self-propelled vehicle, the paving materials loading apparatus including:

a paving materials loading feeder so disposed that a lower end of a loading frame thereof is connected to a receiving hopper, a discharge port formed in a middle part of said loading frame between the lower end and a discharge end, and a lid provided on the discharge port so as to be openable and closable, wherein said receiving hopper is connected to the loading feeder so as to be pivotal up and down, and wherein the discharge port of said loading feeder is located above said front hopper and the discharge end of said loading feeder is located above said rear hopper.

40. A paving machine comprising:

a front hopper and a rear hopper, on a self-propelled vehicle, and a paving materials loading apparatus mounted on said self-propelled vehicle, wherein the paving materials loading apparatus includes:

a paving materials loading feeder so disposed that a lower end of a loading frame thereof is connected to a receiving hopper, a discharge port formed in a middle part of said loading frame between the lower end and a discharge end, a lid provided on the discharge port so as to be openable and closable, wherein said loading feeder can be raised and lowered, and said receiving hopper is provided with wheels for supporting the load of said receiving hopper, said loading feeder can be freely moved fore and aft and can be freely tilted from side to side, said loading feeder is provided with a stop member for stopping the rearward movement of said loading feeder, and said receiving hopper is provided with a pushing member for pushing a dump truck or the like which replenishes the paving materials into said receiving hopper, and wherein the discharge port of said loading feeder is located above said front hopper and the discharge end of said loading feeder is located above said rear hopper.

41. A paving machine comprising:

a front hopper and a rear hopper, on a self-propelled vehicle, and a paving materials loading apparatus mounted on said self-propelled vehicle, the paving materials loading apparatus including:

a paving materials loading feeder so disposed that a lower end of a loading frame thereof is connected to a receiving hopper, a discharge port formed in a middle part of said loading frame between the lower end and a discharge end, and a lid provided on the discharge port so as to be openable and closable, wherein there is provided supplementary hoppers on the left and right sides of said receiving hopper so as to be foldable over said receiving hopper, and wherein the discharge port of said loading feeder is located above said front hopper and the discharge end of said loading feeder is located above said rear hopper.

42. A paving machine comprising:

a front hopper and a rear hopper, on a self-propelled vehicle, and a paving materials loading apparatus mounted on said self-propelled vehicle, wherein the paving materials loading apparatus includes:

a paving materials loading feeder so disposed that a lower end of a loading frame thereof is connected to a receiving hopper, a discharge port formed in a middle part of said loading frame between the lower end and a discharge end, a lid provided on the discharge port so as to be openable and closable, wherein said loading feeder comprises an endless chain with flights attached thereto, tensioned between rotation shafts rotatable disposed respectively at the lower end and the discharge end of said loading frame, and wherein the discharge port of said loading feeder is located above said front hopper and the discharge end of said loading feeder is located above said rear hopper.

43. A paving machine comprising:

a front hopper and a rear hopper, on a self-propelled vehicle, and a paving materials loading apparatus mounted on said self-propelled vehicle, the paving materials loading apparatus including:

a paving materials loading feeder so disposed that a lower end of a loading frame thereof is connected to a receiving hopper, at least two discharge ports formed in a middle part of said loading frame between the lower end and a discharge end, and a lid provided on each of the discharge ports so as to be openable and closable, wherein the discharge ports is located above said front hopper and the discharge end of said loading feeder are located above said rear hopper.

* * * * *